US009309766B2

(12) United States Patent
Feustel

(10) Patent No.: US 9,309,766 B2
(45) **Date of Patent: *Apr. 12, 2016**

(54) REFRIGERATION SYSTEM INCLUDING A ROTARY EXPANSIBLE CHAMBER DEVICE HAVING ADJUSTABLE WORKING-FLUID PORTS

(71) Applicant: Aaron Feustel, Claremont, NH (US)

(72) Inventor: Aaron Feustel, Claremont, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/236,755

(22) PCT Filed: Aug. 6, 2013

(86) PCT No.: PCT/US2013/053788

§ 371 (c)(1),
(2) Date: Feb. 3, 2014

(87) PCT Pub. No.: WO2014/025778

PCT Pub. Date: Feb. 13, 2014

(65) Prior Publication Data

US 2015/0247405 A1 Sep. 3, 2015

Related U.S. Application Data

(60) Provisional application No. 61/680,970, filed on Aug. 8, 2012.

(51) Int. Cl.
*F01C 11/00* (2006.01)
*F01C 1/10* (2006.01)
(Continued)

(52) U.S. Cl.
CPC ... *F01C 1/10* (2013.01); *F01C 1/30* (2013.01); *F01C 20/04* (2013.01); *F01C 20/10* (2013.01);
(Continued)

(58) Field of Classification Search
CPC ..... F01C 1/00; F01C 11/002; F01C 21/186; F25B 1/04
USPC ..... 62/172
See application file for complete search history.

(56) References Cited

U.S. PATENT DOCUMENTS 1,076,299 A 10/1913 Marshall
1,418,741 A 6/1922 Stallman
(Continued)

FOREIGN PATENT DOCUMENTS

DE 4222644 1/1994
DE 102007030853 1/2009
(Continued)

OTHER PUBLICATIONS

Amendment and Response to Non-Final Office Action dated Oct. 13, 2014, in connection with related U.S. Appl. No. 14/147,189, filed Jan. 3, 2014, Aaron Feustel. pp. 1-14.
(Continued)

*Primary Examiner* — Jonathan Bradford
(74) *Attorney, Agent, or Firm* — Downs Rachlin Martin PLLC

(57) ABSTRACT

Rotary expansible chamber (REC) devices having one or more working-fluid ports that are adjustable, for example, in size or location. In some embodiments, the variable port mechanisms can be used to control any one or more of a plurality of operating parameters of a REC device independently of one or more others of the operating parameters. In some embodiments, the REC devices can have a plurality of fluid volumes that change in size during rotation of the REC device, and that transition to a zero volume condition during the rotation of the REC device. Systems are also provided that can include one or more REC devices. Methods for controlling various aspects of REC devices, including methods of controlling one or more operating parameters, are also provided.

3 Claims, 9 Drawing Sheets

(51) Int. Cl.

| | |
|---|---|
| ***F01C 1/30*** | (2006.01) |
| ***F01C 20/04*** | (2006.01) |
| ***F01C 20/14*** | (2006.01) |
| ***F04C 2/08*** | (2006.01) |
| ***F01C 20/10*** | (2006.01) |
| ***F04C 2/04*** | (2006.01) |
| ***F04C 14/22*** | (2006.01) |
| ***F04C 29/04*** | (2006.01) |
| ***F01C 21/08*** | (2006.01) |
| ***F01C 21/18*** | (2006.01) |
| ***F04C 18/10*** | (2006.01) |
| ***F04C 29/12*** | (2006.01) |

(52) U.S. Cl.

CPC ..... *F01C 20/14* (2013.01); *F01C 21/0809* (2013.01); *F01C 21/186* (2013.01); *F04C 2/04* (2013.01); *F04C 2/082* (2013.01); *F04C 14/22* (2013.01); *F04C 18/10* (2013.01); *F04C 29/04* (2013.01); *F04C 29/12* (2013.01); *F01C 11/002* (2013.01)

(56) References Cited

U.S. PATENT DOCUMENTS

| | | | |
|---|---|---|---|
| 2,159,941 | A | 5/1939 | Guinness |
| 2,470,670 | A | 5/1949 | Winkler et al. |
| 2,991,930 | A | 7/1961 | Lindner |
| 3,022,741 | A | 2/1962 | Brundage |
| 3,029,738 | A | 4/1962 | Clar |
| 3,103,893 | A | 9/1963 | Henning et al. |
| 3,191,541 | A | 6/1965 | Brown |
| 3,334,546 | A | 8/1967 | Vuolle-Apiala |
| 3,637,332 | A | 1/1972 | McAnally, III |
| 3,797,975 | A | 3/1974 | Keller |
| 4,005,949 | A | 2/1977 | Grant |
| 4,241,713 | A | 12/1980 | Crutchfield |
| 4,272,227 | A | 6/1981 | Woodruff |
| 4,413,960 | A | 11/1983 | Specht |
| 4,421,462 | A | 12/1983 | Ohe |
| 4,508,089 | A | 4/1985 | Baumgartner et al. |
| 4,710,110 | A | 12/1987 | Paulus |
| 4,960,371 | A | 10/1990 | Bassett |
| 5,108,275 | A | 4/1992 | Sager |
| 5,246,358 | A | 9/1993 | Gu |
| 5,518,382 | A | 5/1996 | Gennaro |
| 5,533,566 | A | 7/1996 | Fineblum |
| 5,558,511 | A | 9/1996 | Hedelin |
| 5,609,475 | A | 3/1997 | Eiermann |
| 6,164,943 | A | 12/2000 | Arbogast et al. |
| 6,206,666 | B1 | 3/2001 | Steinrock et al. |
| 6,659,744 | B1 | 12/2003 | Raymond, Jr. |
| 7,073,775 | B2 | 7/2006 | Kabir et al. |
| 7,478,629 | B2 | 1/2009 | del Valle Bravo et al. |
| 7,588,427 | B2 | 9/2009 | Bae et al. |
| 7,823,398 | B2 | 11/2010 | Glen |
| 8,424,284 | B2 | 4/2013 | Staffend et al. |
| 8,950,169 | B2 | 2/2015 | Feustel |
| 9,080,568 | B2 * | 7/2015 | Feustel |
| 2004/0170512 | A1 | 9/2004 | Yannascoli et al. |
| 2008/0041056 | A1 | 2/2008 | Carnahan |
| 2008/0240964 | A1 | 10/2008 | Kimura et al. |
| 2009/0022585 | A1 | 1/2009 | Akbayir |
| 2009/0160135 | A1 | 6/2009 | Turini et al. |
| 2009/0304496 | A1 | 12/2009 | Maier |
| 2010/0050628 | A1 * | 3/2010 | Staffend et al. ..... 60/508 |
| 2010/0150702 | A1 | 6/2010 | Sheridan et al. |
| 2011/0209477 | A1 | 9/2011 | Frazier et al. |
| 2012/0000199 | A1 | 1/2012 | Hartfield, Jr. |

FOREIGN PATENT DOCUMENTS

| | | | |
|---|---|---|---|
| DE | 102008054746 | | 6/2010 |
| DE | 102009060189 | | 6/2011 |
| EP | 0049838 | | 4/1982 |
| EP | 0846861 | | 6/1998 |
| EP | 0903835 | A1 | 3/1999 |
| EP | 1852608 | | 11/2007 |
| EP | 2224136 | | 9/2010 |
| EP | 2261508 | | 12/2010 |
| EP | 2261508 | A1 | 12/2010 |
| FR | 1464360 | | 3/1967 |
| FR | 2739900 | A1 | 4/1997 |
| GB | 191515825 | | 12/1916 |
| GB | 339021 | | 12/1930 |
| GB | 349191 | | 5/1931 |
| GB | 353331 | | 7/1931 |
| GB | 792463 | | 3/1958 |
| GB | 881177 | A | 11/1961 |
| GB | 1405339 | | 9/1975 |
| GB | 2129497 | | 5/1984 |
| WO | 03012257 | | 2/2003 |
| WO | 2010048970 | | 5/2010 |
| WO | 2010083416 | A1 | 7/2010 |
| WO | 2012056470 | | 5/2012 |
| WO | 2012084307 | | 6/2012 |

OTHER PUBLICATIONS

Non-Final Rejection Office Action dated Jul. 22, 2014 related U.S. Appl. No. 14/147,189, filed Jan. 3, 2014, Aaron Feustel.

International Search Report and Written Opinion dated Nov. 6, 2013, in connection with related PCT/US2013/053788.

Heinz P. Bloch, Power Transmission and Advanced Bearing Technology, Chapter 4, Compressors and Modern Process Applications; 2006; pp. 75-94.

Diab Y, et al., Experimental and numerical investigations on the air-pumping phenomenon in high-speed spur and helical gears; Proc. IMechE, vol. 219, Part C: J. Mechanical Engineering Science; 2005; pp. 785-800.

Pillis, J.W. ; Basics of Operation, Application & Troubleshooting of Screw Compressors; Frick; Jan. 1998; pp. 1-27.

Wang, D., et al.; Research on the Discharge Port of Scroll Oil Pump; Purdue University Purdue e-Pubs; International Compressor Engineering Conference School of Mechanical Engineering; 1992; pp. 611-621.

Non-Final Office Action dated Mar. 5, 2015, in connection with related U.S. Appl. No. 14/571,357, filed Dec. 16, 2014, Aaron Feustel. pp. 1-12.

Amendment and Response to Non-Final Office Action dated Mar. 25, 2015, in connection with related U.S. Appl. No. 14/571,357, filed Dec. 16, 2014, Aaron Feustel. pp. 1-15.

Supplementary European Search Report dated Jun. 10, 2015 issued in connection with related EP 13 82 8111, filed Mar. 5, 2015.

Shelley, Tom, "Sickle Machine Reaps," Jan. 1, 2001, pp. 26-27, vol. 21, No. 1, Eureka, Findlay Publications, LTD., Dartford, Great Britain; ISSN:0261-2097.

* cited by examiner

REFRIGERATION SYSTEM INCLUDING A ROTARY EXPANSIBLE CHAMBER DEVICE HAVING ADJUSTABLE WORKING-FLUID PORTS

FIELD OF THE INVENTION

The present invention generally relates to refrigeration system. In particular, the present invention is directed to a refrigeration system including a rotary expansible chamber devices having adjustable working-fluid ports.

BACKGROUND

Rotary expansible chamber devices are made up of at least one body that rotates relative to another body and that defines in conjunction with that other body the boundary of a fluid zone that is configured to receive a working fluid during use. The fluid zone is typically comprised of a plurality of fluid volumes that increase and decrease in size as the rotating body rotates. Rotary expansible chamber devices can be used, for example, as compressors, where a compressible fluid enters the plurality of fluid volumes and is compressed as the fluid volumes decrease in size, or the devices can be used as expanders, where the energy from a compressible fluid is transferred to the rotating body as the fluid is allowed to expand within the fluid volumes.

A 360° rotation of the rotating body(ies) of a rotary expansible chamber device can be divided into a number of arcs, each of which describes one of the following three categories: a) a shrinking arc, in which the volume of the working fluid partially or fully bounded by the body(ies) is shrinking, b) an expanding arc, in which the volume of fluid partially or fully bounded by the body(ies) is expanding, and c) a constant volume arc, in which the volume of fluid partially or fully bounded by the body(ies) is not changing in size. These arcs may or may not move with some relation to the rotating body(ies). At locations generally relative to these arcs are openings or ports which allow fluid to enter and leave the fluid zone.

An expansible chamber device can have a variety of operating parameters, such as the rotation rate of the device, the mass flow rate of a working fluid, the working fluid output temperature and pressure, and the energy either produced or consumed by the device. However, prior art devices are poorly equipped to control one or more of these parameters independently of the other operating parameters, and are poorly equipped to do so in an energy efficient manner.

SUMMARY OF THE DISCLOSURE

In one implementation, the present disclosure is directed to a rotary expansible chamber device. The device includes an outer rotary component having a machine axis, an inner rotary component located relative to the outer rotary component so as to define a fluid zone between the inner and outer components, the fluid zone for receiving a working fluid during use, wherein the inner and outer rotary components are designed and configured to engage one another so that, when at least one of the inner and outer rotary components is continuously moved relative to the other about an axis parallel to the machine axis, the inner and outer rotary components continuously define at least one shrinking arc, at least one expanding arc, and at least one zero volume arc within the fluid zone; a first working-fluid port in fluid communication with the fluid zone and having a first circumferential extent and a first angular position about the machine axis; and a first mechanism designed and configured to controllably change at least one of the first circumferential extent and the first angular position.

In another implementation, the present disclosure is directed to an energy recovery system. The system includes a first rotary expansible chamber device having an adjustable working fluid output port and a first port-adjustment mechanism designed and configured to controllably adjust at least one of a size and location of the output port; a second rotary expansible chamber device having an adjustable working fluid input port and a second port-adjustment mechanism designed and configured to controllably adjust at least one of a size and location of the input port, the first rotary expansible chamber device mechanically coupled to the second rotary expansible chamber device; and a condenser fluidly coupled to the output of the first rotary expansible chamber device and fluidly coupled to the input of the second rotary expansible chamber device; wherein the system is designed and configured to recover energy from a working fluid by exhausting the working fluid from the output port of the first rotary expansible chamber device at a pressure below an ambient pressure, condense the working fluid, and then recompress the working fluid with the second rotary expansible chamber device to a pressure substantially the same as the ambient pressure.

In still another implementation, the present disclosure is directed to a single-phase refrigeration system. The system includes a first rotary expansible chamber device having a first input port, a first output port, and a first port-adjustment mechanism designed and configured to controllably adjust a size or location, or both, of at least one of the first input port and the first output port; a second rotary expansible chamber device having a second input port and a second output port, and a second port-adjustment mechanism designed and configured to controllably adjust at least one of the second input port and the second output port, the first rotary expansible chamber device mechanically coupled to the second rotary expansible chamber device; and first and second heat exchangers, the first heat exchanger fluidly coupled to the first output port and the second input port and the second heat exchanger fluidly coupled to the second output port and the first input port; wherein the system is configured to function as a closed-loop refrigeration cycle with a compressible single-phase working fluid, wherein both of the first and second rotary expansible chamber devices are designed and configured to control a mass flow rate of the working fluid independently of a temperature or pressure differential across the first and second rotary expansible chamber devices by adjusting the first and second port-adjustment mechanisms.

In yet another implementation, the present disclosure is directed to a heating system configured to transfer heat to a controlled environment. The heating system includes an open cycle engine coupled to a closed cycle engine; the open cycle engine comprising first and second rotary expansible chamber devices, and the closed cycle engine comprising third and fourth rotary expansible chamber devices, wherein the first, second, third, and fourth rotary expansible chamber devices are mechanically coupled with one another for coupled rotary operation thereof; the open cycle engine having a combustion chamber coupled to the first and second rotary expansible chamber devices and configured to heat a first working fluid that has been compressed by the first rotary expansible chamber device, the second rotary expansible chamber device configured to extract energy from the first working fluid output by the combustion chamber; the closed cycle engine being thermally coupled to the open cycle engine by a first heat exchanger configured to transfer heat from the first working fluid to a second working fluid; and the third and fourth rotary expansible chamber devices being coupled to the first heat exchanger and a second heat exchanger, thereby forming a closed loop, the second heat exchanger being thermally coupled to a controlled environment such that the heating system is configured to transfer heat to the controlled environment; wherein each of the first, second, third, and fourth rotary expansible chamber devices has at least one adjustable port and at least one adjustment mechanism for adjusting a size or location, or both, of the port, the first and second rotary expansible chamber devices being configured to control a pressure or temperature of the first working fluid independently of a mass flow rate of the first working fluid and a rotation rate of the rotary expansible chamber devices, the second and third rotary expansible chamber devices being configured to control a pressure or temperature of the second working fluid independently of a mass flow rate of the second working fluid and the rotation rate of the rotary expansible chamber devices.

In still yet another implementation, the present disclosure is directed to a method of controlling a rotary expansible chamber device having inner and outer rotary components defining therebetween a fluid zone that, when the rotary expansible chamber device is operating, contains at least one shrinking arc and at least one expanding arc. The method includes determining at least one of 1) a desired circumferential opening extent of a first port on the rotary expansible chamber device that is in fluid communication with the fluid zone and 2) a desired angular position of the first port; and adjusting the first port to achieve either the desired circumferential opening extent or the desired angular position, or both, so as to control a first operating parameter independently of a second operating parameter.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

Some aspects of the present invention include various variable-port mechanisms, control systems, and methods for repeatably and predictably changing any one or more of a plurality of operating parameters of a rotating expansible-chamber (REC) device independently of one or more others of the operating parameters in an energy efficient and effective manner. Other aspects of the present invention includes REC devices and REC-device-based systems that incorporate such variable-port mechanisms and control systems, individually and together, and/or utilize such methods. As will become apparent from reading this entire disclosure, REC devices that can benefit from such variable-port mechanisms, control systems, and methods include, but are not limited to, vane-type REC devices, gerotor-type REC devices, and eccentric-rotor-type REC devices. Moreover, the benefits that can result from implementing such variable-port mechanisms, control systems, and/or methods can be enjoyed regardless of the role of the REC device, such as whether it is functioning as a compressor, expander, pump, motor, etc., and combinations thereof. Indeed, the benefits that aspects of the present invention provide can make REC devices highly desirable in terms of performance for any of these functions and may also lead to implementing REC devices in systems, such as vehicle propulsion/energy recovery systems, heat generator, short and long distance power transmission, and heat pumps, among many others, wherein uses of conventional REC devices may have heretofore not been seriously considered because of their performance limitations.

Figure 1:
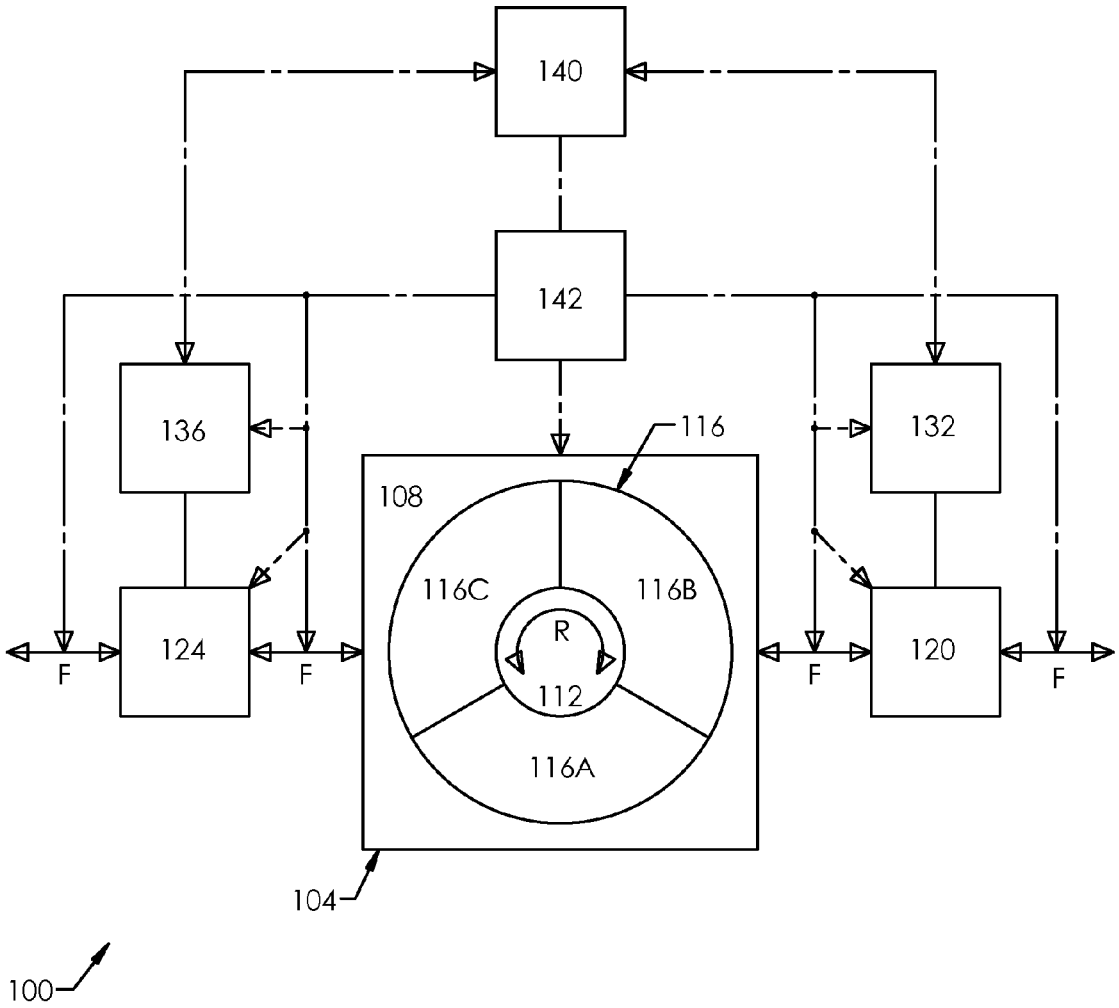
FIG. 1 is a schematic diagram of a rotating expansible-chamber (REC) device system made in accordance with the present invention.

In view of the broad applicability of the various aspects of the present invention to REC devices and systems incorporating such devices, FIG. 1 of the accompanying drawings introduces some of the general features and principles underlying the variable-port functionalities described herein and exemplified with particular examples in the remaining figures and accompanying description. Referring now to FIG. 1, this figure illustrates an exemplary embodiment of an REC device system 100 that is capable of repeatably and predictably controlling any one or more of a plurality of operating parameters of the system independently of other operating parameters in an energy efficient manner. System 100 includes an REC device 104, which in this example comprises an outer rotary component 108 and an inner rotary component 112 that together (and with any end pieces (not shown), such as plates or housing component(s)) define a fluid zone 116 that receives a working fluid, F, during use. It is noted that the term "rotary component" as used herein and in the appended claims shall mean a component that is either a rotational component, such as a rotor, gear, eccentric rotor, eccentric gear, etc., that rotates or has a rotational component during use, or a stationary component, such as a stator, that is engaged by a rotational component during use. As those skilled in the art will appreciate, an REC device of the present disclosure, such as REC device 104, can have one or more rotational components. In the embodiment shown, which has inner and outer rotary components 108 and 112, respective, one, the other, or both of the inner and outer rotary components can be rotational components.

In the illustrated embodiment, during operation inner rotary component 112 can rotate in either direction as indicated by double arrow R. By virtue of the inter-engagement of outer and inner rotary components 108 and 112, fluid zone 116 has a plurality of fluid volumes defined therebetween, at least one of which increases and decreases in size during movement of inner rotary component 112, depending on the direction of its rotation. During use, whether a given fluid volume is increasing or decreasing in size at a given circumferential position depends on the rotational direction of inner rotary component 112 and the arc through which it is traveling. In the embodiment shown, a complete rotation of inner rotary component 112 includes 1) an expanding-volume arc 116A, in which the fluid volumes are increasing in size, 2) a shrinking-volume arc 116B in which the fluid volumes are decreasing in size, and 3) a constant-volume arc 116C in which the fluid volumes remain substantially the same size. In other embodiments, an REC device can have more than one expanding-volume arc, more than one shrinking-volume arc, and zero or more than one constant-volume arc.

REC device 104 further includes at least one adjustable working-fluid port in fluid communication with fluid zone 116 for the purpose of communicating working fluid F to the fluid zone or communicating working fluid from the fluid zone. In the example shown, REC device 104 has two adjustable working fluid ports 120 and 124. In the illustrated embodiment, working fluid F within fluid zone 116, more specifically within various ones of the plurality of fluid volume arcs 116A to 116C, may gain access to adjustable ports 120 and 124 during certain portions of the rotation of inner rotary component 112. During other portions of the rotation of inner rotary component 112, ones of the fluid volume arcs 116A to 116C may be fully bounded and may not be in fluid communication with either adjustable port 120 or adjustable port 124. Depending on the configuration of REC device 104, fluid zone 116 may have access to adjustable port 120 or adjustable port 124 during any one of the expanding, shrinking, and constant volume arcs 116A, 116B, and 116C. In addition and as alluded to above, adjustable ports 120 and 124 can be located in a variety of locations on REC device 104, for example, they can be located on an outer circumferential surface of the device, at a position radially inward from the outer circumferential surface, or on a longitudinal end of the device, among others. As will become apparent from reading this entire disclosure, each adjustable port 120 and 124 can be adjustable in circumferential, or angular position, flow area, or both. In this connection, it is noted that the term "circumferential" refers to directionality only, and not location.

Regarding angular position, if so enabled, the angular position of each adjustable port 120 and 124 can be adjusted such that the portion(s) of fluid zone 116 over which fluid F has access to either of adjustable ports 120 and 124 can be changed. For example, the angular position of adjustable port 120 can be changed from a first position, wherein fluid F within fluid zone 116 gains access to that port at the beginning of expanding volume arc 116A, to a second position, wherein the fluid within the fluid zone does not gain access to adjustable port 120 until the middle or end of expanding-volume arc 116A. The angular position of adjustable port 120 may also be adjusted such that the moving volume arcs only gain access to that port during a portion of shrinking-volume arc 116B or constant-volume arc 116C. Similarly, the angular position of adjustable port 124 can be adjusted to vary the location along volume arcs 116A to 116C where fluid F within fluid zone 116 gains access to that port.

Regarding adjustability of flow area, the size of the flow area of an adjustable port of the present disclosure, such as either of adjustable ports 120 and 124, can be varied in any suitable manner, such as by varying its circumferential extent (e.g., which can be denoted as circumferential length or circumferential width, depending on preference) or by varying its axial extent (e.g., length or width (depending on preference) in a direction parallel to an axis of rotation of one of the rotary components), or by varying both. For example, the circumferential extent of adjustable ports 120 and 124 may be adjusted such that the portion of the one or more arcs 116A to 116C over which fluid F within fluid zone 116 gains access to the ports can be changed. For example, adjustable port 120 can be adjusted from a first circumferential extent, wherein fluid F within fluid zone 116 gains access to that port over a first percentage of expanding arc 116A to a second, larger circumferential extent, where the fluid within the fluid zone gains access to the first port 112 over a second, larger percentage of expanding arc 116A. As noted above, the axial extent of either or both of adjustable ports 120 and 124 may also be adjustable, such that fluid F within fluid zone 116 may have access to such ports over a larger flow area along longitudinal axis 128 of REC device 104. Through adjusting one or more of the angular position, circumferential extent, and axial extent of the one or more working-fluid ports, the location(s) and flow area(s) at which the working fluid within the fluid zone is in fluid communication with fluid systems (not shown) external to the REC device can be highly precisely tuned to operating conditions and desired performance.

As will also be seen below, adjustable ports of the present disclosure, such as ports 120 and 124, can also be made adjustable by selectively joining the ports with one another and/or with one or more non-adjustable ports outside of the corresponding fluid zone, such as fluid zone 116. Depending on a variety of factors, including the function of REC device 104 in a particular application, adjustable ports 120 and 124 may be of opposite types, i.e., one inlet port and one outlet port, or may be of the same type, i.e., both are inlet ports or both are outlet ports. In other embodiments, an REC device of the present disclosure may have more or fewer than two adjustable ports. In addition, although not shown in FIG. 1, an REC device of the present disclosure may also include one or more non-adjustable ports.

Each adjustable port 120 and 124 is made adjustable using one or more adjusting mechanisms 132 and 136, respectively. Examples of adjusting mechanisms suitable for use as adjusting mechanisms 132 and 136 include, but are not limited to, circumferential slides, helical slides, rotatable rings, rotatable plates, movable wedges, and any necessary actuators (e.g., electrical motors, hydraulic actuators, pneumatic actuators, linear motors, etc.), any necessary transmissions (e.g., worm gears, racks and pinions, etc.), and any necessary components for supporting such devices. After reading this entire disclosure, including the detailed examples described below, those skilled in the art will readily be able to select, design, and implement a suitable adjusting mechanism for any given adjustable port made in accordance with the present invention. REC device system 100 further includes one or more controllers, here a single controller 140, that may be designed and configured to control the angular position and/or flow area size of adjustable ports 120 and 124. As will be described more fully below, the controller(s), such as controller 140, can be designed and configured to adjust any one or more adjustable ports, such as adjustable ports 120 and 124, so as to control one or more operating parameters independently of a plurality of other operating parameters. As those skilled in the art will readily appreciate, REC device system 100 may also include one or more sensors 142. For example, one or more sensors 142 may be utilized in connection with controller 140 and one or both of mechanisms 132 and 136 to monitor one or more parameters, for example, a position of the mechanisms, a temperature, pressure, or mass flow rate of working fluid F at one or more locations, and the rotation rate of one or more rotary components, as well as a variety of other parameters.

In some embodiments, REC device 104 may be fully reversible such that inner rotary component 112 can rotate in either direction, as indicated by arrow R. The direction of flow of working fluid F may also be reversible such that either adjustable port 120 or 124 can be a working-fluid input port and the other port can be a working-fluid output port. Also, in some embodiments, the direction of flow can reversed without changing the direction of rotation of the inner rotary component 112. As mentioned above, in alternative embodiments, the device can have additional ports, for example, the device may have two or more input ports and two or more output ports, and one or more of the ports can be adjustable. When the angular position and/or the size of a working-fluid input port is adjusted, the arc of access to the input port can change, which can change a mass of working fluid that enters the fluid volumes. Also, adjusting the input port can change the arc over which the fluid volumes do not have access to a port, also called an arc of inaccessibility. Changing the circumferential location and size of an arc of inaccessibility can alter the percent of change in volume of the working-fluid. Also, adjusting the angular position and/or the size of the working-fluid output port can also change the circumferential location and size of an arc of inaccessibility. As described more fully below, by controlling some or all of the input ports and output ports, any one of a plurality of operating parameters can be repeatably and predictably controlled in an energy efficient manner independently of the other operating parameters.

In the illustrated embodiment, REC device 104 is configured to compress or decompress a compressible fluid to a desired pressure while it is in an isolated volume or chamber, for example, within the plurality of volumes in fluid zone 116, before it is expelled from said chamber. The plurality of volumes may also transition to a zero or substantially zero volume at the beginning and end of each cycle, which can maximize the efficiency of the device. Transitioning to a substantially zero volume can increase efficiency by ensuring each of the plurality of volumes begins and ends with no carry-over of working fluid F. This is in contrast to allowing working fluid F which has reached the exhaust pressure to be retained in the chamber and allowed to return to the intake pressure in an uncontrolled manner.

Figure 2A:
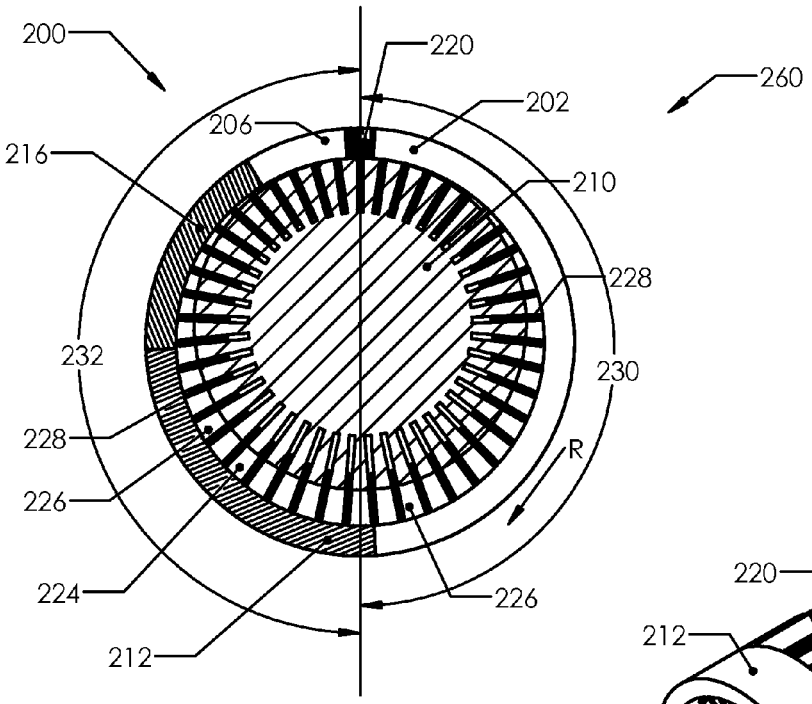
FIG. 2A is a transverse cross-sectional view of a vane-type REC device.
Figure 2B:
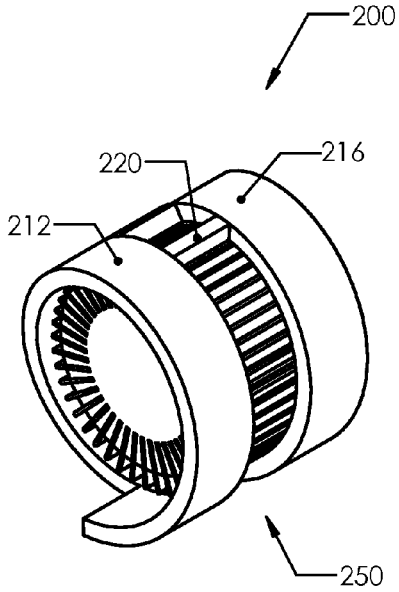
FIG. 2B is an isometric view of the vane-type REC device of FIG. 2A.
Figure 2C:
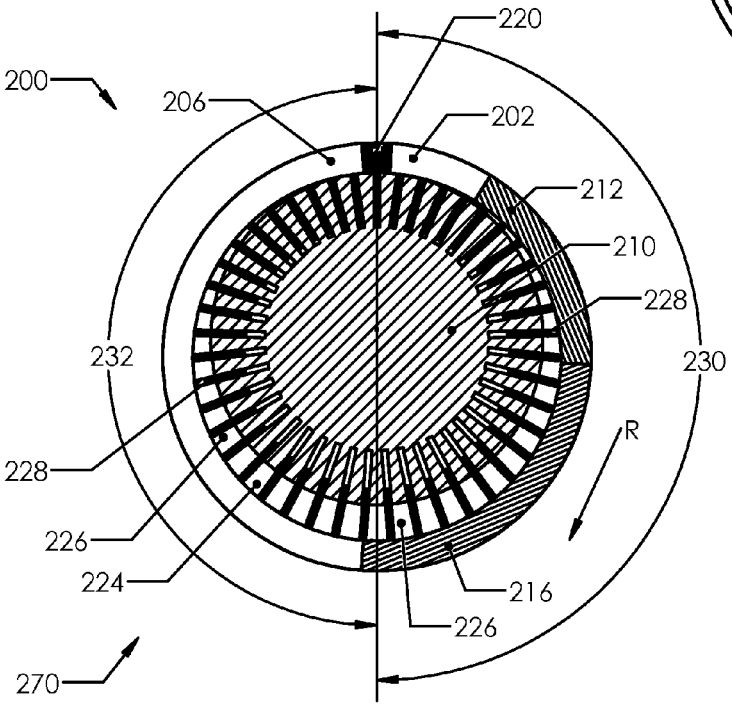
FIG. 2C is a transverse cross-sectional view of the vane-type REC device of FIGS. 2A and 2B in a different state.

Referring now to FIG. 2A-2C, these figure illustrate a specific exemplary embodiment of a vane-type REC device 200 having two adjustable ports 202 and 206, which are described more fully below. As shown in FIG. 2A-2C, REC device 200 includes a rotor 210 rotatably disposed within a set of two helical slides 212 and 216, and one wedge 220. As will be readily understood, rotor 210 corresponds to inner rotary component 112 of FIG. 1, and the set of helical slides 212 and 216 and wedge 220 can correspond to one or more of outer rotary component 108 and mechanisms 132 and 136 of FIG. 1. Slides 212 and 216 partially define fluid ports 202 and 206, and slides 212 and 216 and rotor 210 define a fluid zone 224 therebetween. Fluid zone 224 is comprised of a plurality of fluid volumes 226 (only two of which are labeled to avoid clutter) and is configured to receive a working fluid (not shown) during use. Fluid volumes 226 are defined by a plurality of vanes 228 (only a two of which are labeled to avoid clutter) which are slidably disposed within an outer circumferential surface of rotor 210. The plurality of vanes 228 are configured to slide radially inwards and outwards as rotor 210 rotates so that the vanes remain in contact with slides 212 and 216 throughout the rotation of the rotor. If rotor 210 rotates clockwise as shown by the arrow R, a 360° rotation of the rotor includes an expanding arc 230 and a shrinking arc 232. In the illustrated embodiment, ones of the plurality of volumes 226 increase in size as they travel across expanding arc 230 and decrease in size as they travel across shrinking arc 232.

In the embodiment shown, vane-type REC device 200 has two adjustable ports 202 and 206, with port 202 being an intake port and port 206 being an exhaust port. Ports 202 and 206 are defined and made adjustable by adjustable slides 212 and 216 and wedge 220. Intake port 202 is defined by adjustable slide 212 (intake slide) and wedge 220. Similarly, exhaust port 206 is defined by adjustable slide 216 (exhaust slide) and wedge 220. In the illustrated embodiment, intake slide 212, exhaust slide 218, and wedge 220 form a helix. In some embodiments, wedge 220 may be moved away from rotor 210 radially to join the two ports the wedge separates, for example, ports 202 and 206. Wedge 220 may also be moved circumferentially to change the locations of the ports 202 and 206. In addition, slides 212 and 216 may both be moved circumferentially to increase or decrease the circumferential extents, or sizes, of the respective ports 202 and 206, which will change the arc of access of fluid zone 224 to those ports. In some embodiments, one or more of circumferential slides 212 and 216 may be rotated 180° or more to provide more than the 90° of access to a particular one or more of ports 202 and 206. Slides 212 and 216 may also be rotated counter to each other to such an extent that ports 202 and 206 are joined.

Figure 3A:
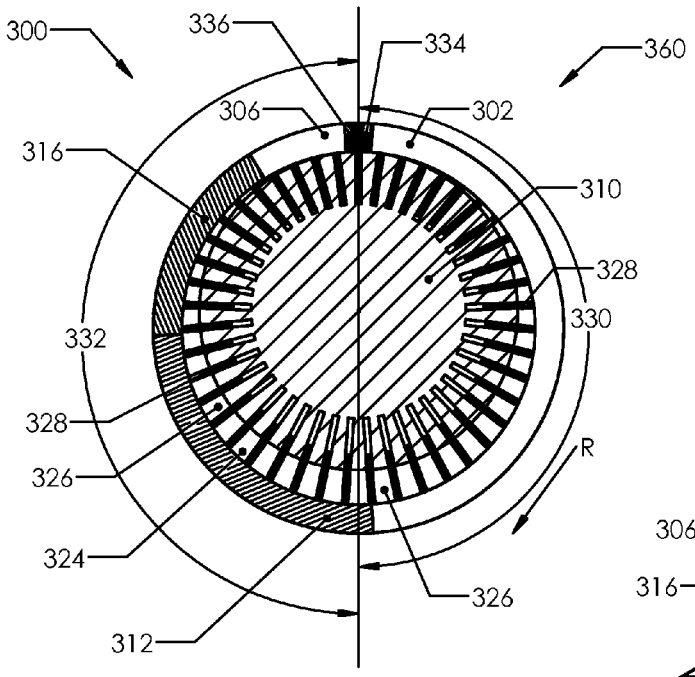
FIG. 3A is a transverse cross-sectional view of a vane-type REC device having six slides.
Figure 3B:
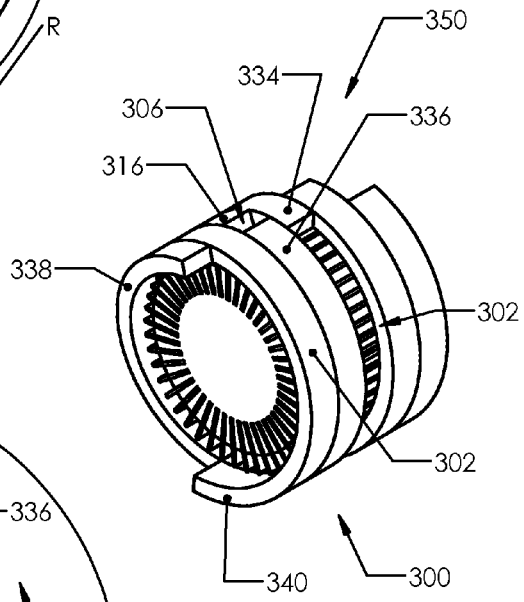
FIG. 3B is an isometric view of the vane-type REC device of FIG. 3A.
Figure 3C:
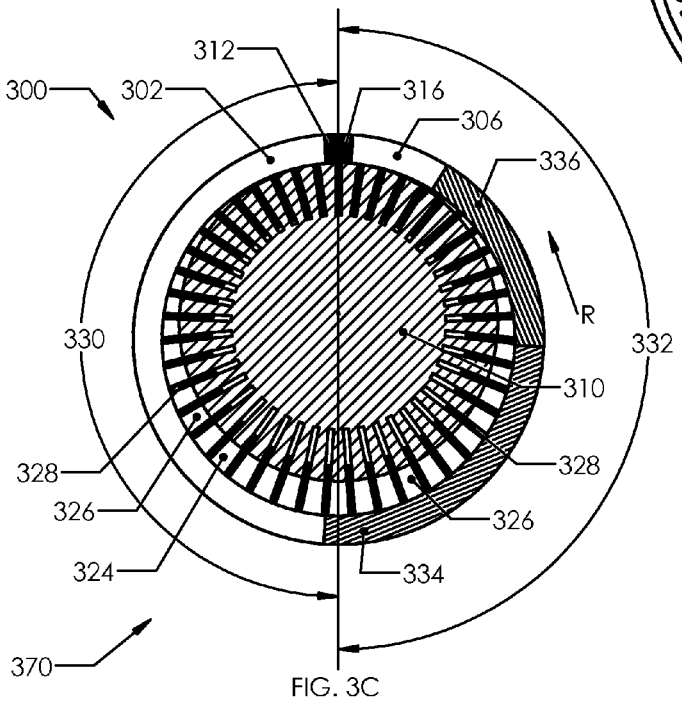
FIG. 3C is a transverse cross-sectional view of the vane-type REC device of FIGS. 3A and 3B in a different state.

In the illustrated embodiment, wedge 220 may be adjusted to independently increase or decrease the circumferential extent of ports 202 and 206 by either moving wedge 220 radially to join/divide the ports or circumferentially to change the size of the ports. In the illustrated embodiment, wedge 220 divides the ports, which have a constant arc between them, the ports defined by being placed circumferentially between two slides in corresponding slide helix, while slides may be used to provide variability over the intervening arc between two ports and are defined as being placed at the ends of each slide helix as shown in state 250 in FIG. 2B, which is an isometric view of FIG. 2A and in the same state as state 260. In some embodiments, each wedge 220 may be replaced by two circumferential slides, for example, a helix may be divided into two helixes, as illustrated in FIGS. 3A-C (discussed more fully below). In some embodiments, two slides may also be replaced by a single wedge (not shown), and two slide helixes may be consolidated, for example, if it is desirable for one or more of ports 202 and 206 being divided by a wedge to remain at a constant relative spacing as in REC device 200. Though the above description of adjustable slides 212 and 216 describes the slides as having infinite circumferential movement, alternative implementations may constrain the movements of some or all of the slides.

In the embodiment described in FIG. 2A-C, wedge 220 is shown in a position which divides two ports 202 and 206 where a fluid volume 228 will have zero or substantially zero volume. Thus, a fluid volume 228 will pass through a zero volume arc when is passes wedge 220. In the illustrated embodiment, the inner surface of wedge 220 and the outer surface of rotor 210 have complimentary shapes at the zero volume location such that there are substantially no voids where a working fluid F could become trapped. This ensures working fluid F is completely exhausted, which prevents fluid from recirculating through REC device 200, which makes the device more volume efficient. This also prevents fluids which have different pressures and or temperatures from mixing in an uncontrolled manner, thus increasing the energy efficiency of REC device 200. This functionality may be replaced by two circumferential slides as stated previously.

From the ideal gas equation (pV=nRT) from Thermodynamics, it is known that the pressure and temperature of a compressible fluid will increase or decrease in a repeatable and predictable manner when its volume is decreased or increased respectively and when no additional energy is added or removed from the fluid. It is also known that, this resultant pressure and temperature change will be a function of the starting pressure, starting temperature, and the percent of change in volume (either positive or negative), as long as there is no heat added to or removed from the system, and no chemical or nuclear reactions that would change the temperature of the fluid. It follows that, if the desired change in pressure and/or temperature is to be increased, the change in volume should be increased, and that if the desired change in pressure and/or temperature is to be decreased, the change in volume should be decreased.

With this understanding, it can be seen that by adjusting the size and/or angular position of one or more ports, for example, ports 202 and 206, the locations of the beginning and end of each arc of access from the one or more ports to fluid zone 224 (and thus the resulting arcs of inaccessibility to any port) is controlled, thereby controlling: a) the change in volume of each fluid volume 226 as it passes through each arc of access, and thus how much fluid is transmitted to and from each fluid volume 226 in said arc; and b) the change in volume of each fluid volume 226 as it passes through each arc of inaccessibility, and thus the pressure of compressible fluid in fluid volume 226 just before a port, for example, port 206 is provided access to it. In this way, the exhaust pressure and temperature provided by device 200 may be repeatably and predictably changed by changing the size and circumferential extent of an exhaust port, for example, port 206, without a change in the intake pressure, intake temperature, rotation rate of the rotary component(s), for example, rotor 210, or the resulting working fluid mass flow rate.

Unlike adjusting the exhaust port, as described above, changing the angular position and circumferential extent of the intake port, for example, port 202, also changes the volume of fluid that is taken in by the device 200 per rotation of rotor 210, and therefore the resulting mass fluid flow per rotation. In this way, the exhaust pressure, exhaust temperature, and the mass fluid flow rate may be repeatably and predictably changed by changing the size and circumferential extent of the intake port, but without changing the intake pressure, intake temperature, or the rotary component(s) rotation rate.

It is further seen that when the exhaust pressure, temperature, and working fluid mass flow rate are changed as a result of adjusting the intake port, for example, port 202, such as by adjusting the circumferential extent or angular position of the port, those parameters cannot be changed independently by only adjusting the intake port. However, because a change to the exhaust port will change only the exhaust pressure and temperature but not the working fluid mass flow rate, the exhaust port can be adjusted to keep the exhaust pressure and temperature constant when the intake port is adjusted to provide the desired working fluid mass flow rate but would otherwise change said exhaust pressure and temperature. Thus, by changing the size and circumferential extents of both the intake and exhaust ports, the working fluid mass flow rate may be repeatably and predictably changed without requiring a change to the intake pressure, intake temperature, the rotation rate of the rotary component(s), exhaust pressure, or exhaust temperature.

The working fluid mass flow rate may also be increased by increasing the rotation rate of the rotary component(s), and this increase is approximately proportional, repeatable, and predictable. However, because the working fluid mass flow rate may be changed independently of the rate of rotation per the above, the rotation rate of the rotary components, for example, rotor 210 and the intake and exhaust ports may be adjusted by changing their size and circumferential extent so that the rotation rate of the rotary component(s) may change without requiring a change to the intake pressure, intake temperature, working fluid mass flow rate, exhaust pressure, or exhaust temperature.

Furthermore, changing the intake pressure correspondingly changes both the mass of the fluid being taken in by device 200 as well as the exhaust pressure. However, because the working fluid mass flow rate and the exhaust pressure may be changed independently of each other and independently of the intake pressure, the intake and exhaust ports may also be adjusted repeatably and predictably by changing their size and circumferential extent so that the intake pressure may change without requiring a change to the rotation rate of the rotary component(s), the working fluid mass flow rate, or the exhaust pressure.

In a similar manner, changing the intake temperature correspondingly changes the exhaust temperature but also changes the mass of the fluid being taken in by the device and thus the working fluid mass flow rate. Also in a similar manner, because both the working fluid mass flow rate and the exhaust temperature may be changed independently of each other and independently of the intake temperature, the intake and exhaust ports may also be repeatably and predictably changed by changing their size and circumferential extent so that the intake temperature may change without requiring a change to the rotation rate of the rotary component(s), the working fluid mass flow rate, or the exhaust temperature.

In addition, because of pV=nRT, temperature can be substituted for pressure and pressure for temperature in the previous two statements. Thus, the above methods can be used to repeatably and predictably change the intake pressure without requiring a change to the exhaust temperature, though the exhaust pressure would change. Similarly, the above methods can be used repeatably and predictably so that the intake temperature may change without requiring a change to the exhaust pressure, though the exhaust temperature would change.

While state 260 shows REC device 200 with slides 212 and 216 positioned so that the pressure and temperature at port 202 are higher than the pressure and temperature at port 206 and thus functions as a compressor, in state 270, slides 212 and 216 are repositioned so that the pressure and temperature at port 206 are lower than the pressure and temperature at port 202. This repositioning does not require a mass fluid flow rate reversal. Instead, the direction of mass flow may remain the same and the fluid may be forcibly expanded instead of forcibly compressed, in which case REC device 200 would be functioning as an expander.

When the direction of rotation of rotor 210 is reversed, the working fluid mass flow is also reversed. For example, if the direction of rotation R is reversed when REC device 200 is in state 260, REC device 200 would function as an expander as shown in state 270. Similarly, if the direction of rotation R in state 270 is reversed, REC device 200 would function as a compressor. Thus, the combination of moveable slides and wedge(s) and a reversible rotor allows REC device 200 to be highly flexible and configurable.

FIGS. 3A-3C illustrate another REC device 300 that is similar to REC device 200 of FIGS. 2A-2C in that it has a rotor 310 rotatably disposed within slides 312 and 316, and slides 312 and 316 partially define ports 302 and 306. In addition, the respective names and functions of features 302, 306, 310, 312, 316, 324, 326, 328, 330, 332, and R in FIGS. 3A-3C are identical to the corresponding features 202, 206, 210, 212, 216, 224, 226, 228, 230, 232, and R in FIGS. 2A-2C respectively, though their shapes and sizes may differ. However, as shown in FIGS. 3A-C, unlike wedge 220 in REC device 200, REC device 300 effectively has a separated wedge in the form of a second intake slide 334 and a second exhaust slide 336, and instead of the single slide helix (not labeled) in REC device 200, REC device 300 has a first slide helix 338 and a second slide helix 340, best seen in FIG. 3B, which is an isometric view of FIG. 3A and in the same state as 360. As with REC device 200, the size of intake port 302 and exhaust port 306 may be changed independently of each other. Because slides 334 and 336 may move independently of each other, the positions of intake port 302 and exhaust port 306 may also be changed independently of each other and may also be switched by changing the circumferential position of the four slides 312, 316, 334, and 336, for example, as shown in FIGS. 3A and 3C, the slides are in a first state 360 in FIG. 3A and can be moved to a second state 370 as shown in FIG. 3C. By doing so, the direction of rotation R may be changed without changing the intake pressure, intake temperature, exhaust pressure, exhaust temperature, working fluid mass flow rate, or rotation rate of the rotary component(s).

This change in rotation direction might also be accomplished by the use of valves (not shown) at the ports.

Figure 4:
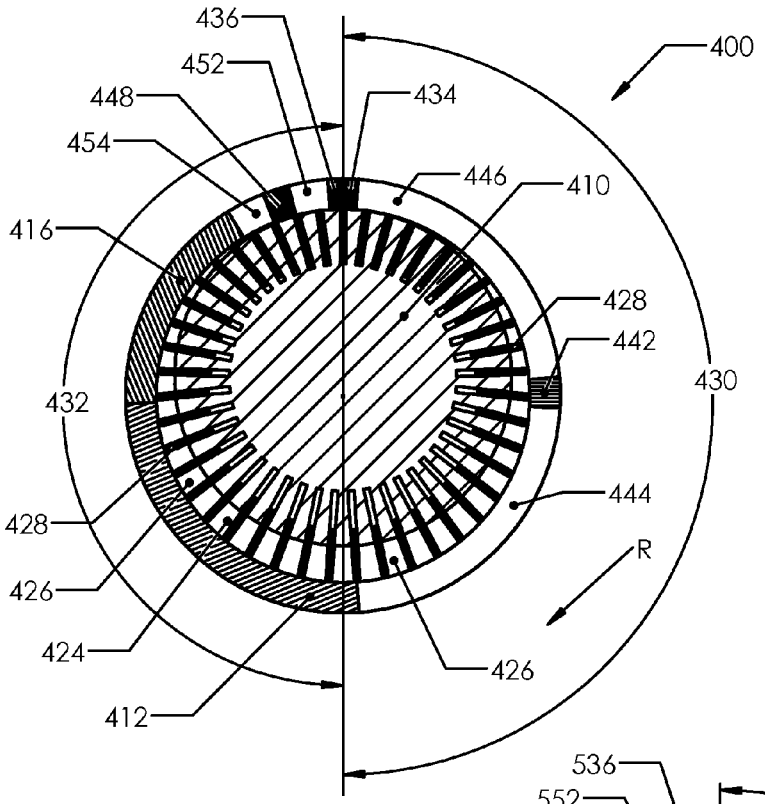
FIG. 4 is a transverse cross-sectional view of a vane-type REC device with two wedges.

FIG. 4 illustrates a further REC device 400 that is similar to REC device 300 shown in FIGS. 3A-3C. In this connection, the respective names and functions of features 410, 412, 416, 424, 426, 428, 430, 432, 434, 436, and R in FIG. 4 are identical to the corresponding features 310, 312, 316, 324, 326, 328, 330, 332, 334, 336 and R in FIGS. 3A-3C, respectively, though their shapes and sizes may differ. FIG. 4 shows how REC device 400 has a further addition of a first wedge 442 that may split what was a single intake port 302 in REC device 300 into a first intake port 444 and a second intake port 446. REC device 400 also has a second wedge 448 that may split what was a single exhaust port 306 in REC device 300 into a first exhaust port 452 and a second exhaust port 454. These wedges 442 and 448 function in a similar but different manner as wedge 220, and, in the illustrated embodiment, are shaped differently. Both wedges 442 and 448 separate two ports by a fixed circumferential arc, but, unlike wedge 220, wedges 442 and 448 separate the two intake ports 444 and 446 from each other and the two exhaust ports 452 and 454 from each other. Each wedge 442 and 448 may be moved circumferentially around its helix to change the size and location of the ports 444, 446, 452, and 454, and radially to join the ports each wedge 442 and 448 separate, and each of these actions may be performed independently of all other actions.

In the illustrated embodiment, added wedge 448 is sized so that, as the rotary components rotate past the wedge 448, there is no point at which the ports 452 and 454 it separates are connected through the fluid volumes 426, but that said fluid volumes 426 will not be disconnected from both exhaust ports 452 and 454 at the same time by wedge 448. Because, in the illustrated embodiment, the volume of fluid in fluid volumes 426 does not change between the two exhaust ports 452 and 454, there is no difference in pressure or temperature at the two exhaust ports 452 and 454. In this way, the two exhaust ports 452 and 454 can have the same exhaust temperature and pressure, and can have a combined working fluid mass flow rate equal to that of a single exhaust port 306 in REC device 300 without wedge 448. In alternative embodiments, ports 452 and 454 may be further divided multiple times with additional wedges to further divide what would otherwise be a single port, such as the single exhaust port 306. Furthermore, wedge 448 and any additional wedges (not shown) added to further divide the exhaust port may be moved to change the proportion of the working fluid mass flow that is expelled into each exhaust port, and these proportion(s) may be changed independently of the exhaust pressure, exhaust temperature, intake pressure, intake temperature, rotary component(s) rotation rate, rotation direction R, and combined working fluid mass flow rate. This can be combined with the ability to change the overall working fluid mass flow rate as described previously to repeatably and predictably change the intake and exhaust port sizes and circumferential extents to change the working fluid mass flow rate out of any exhaust port(s), for example, ports 452 and 454, and in any combination independent of the working fluid mass flow rate out of any other exhaust port(s) 452, 454, intake pressure, intake temperature, rotary component(s) rotation rate, rotation direction R, identical exhaust temperatures, and identical exhaust pressures.

As with wedge 448, added wedge 442 is sized so that, as the rotary components rotate past wedge 442, there is no point at which ports 444 and 446 are connected through the fluid volumes 426 defined by the rotating bodies, but that said fluid volumes 426 will not be disconnected from both intake ports 444 and 446 at the same time by the wedge 442. Because, in the illustrated embodiment, the volume of the fluid in the fluid volumes 426 does not change between the two intake ports 444 and 446, there is no change in pressure or temperature at the two intake ports 444 and 446 induced by REC device 400. As discussed below, the intake port fluid compositions, pressures, and temperatures can be identical (the "first case" described below), and they can be different (the "second case" described below).

In the first case, there are two intake ports 444 and 446 with the same intake temperature and pressure, and with a combined working fluid mass flow rate equivalent to that of a single intake port 302 without wedge 442, and these intake ports 444 and 446 may be further divided multiple times to further divide what was intake port 302. Furthermore, wedge 442 and any additional wedges (not shown) added to further divide what was intake port 302 may be moved to change the proportion of the working fluid mass flow that is drawn into each intake port 444, 446, and (not shown), and these proportion(s) may be changed independently of the intake pressure, intake temperature, exhaust pressure, exhaust temperature, rotary component(s) rotation rate, rotation direction R, and combined working fluid mass flow rate. This can be combined with the ability to change the overall working fluid mass flow rate as described previously to repeatably and predictably change the intake and exhaust port sizes and circumferential extents to change the working fluid mass flow rate into any of the intake port(s) 444, 446, and (not shown) in any combination independent of the work fluid mass flow rate into any other intake port(s) 444, 446, and (not shown), identical intake pressures, identical intake temperatures, rotary component(s) rotation rate, rotation direction R, exhaust temperature, or exhaust pressure. When further combined with dividing the exhaust port 306 as described above, the intake and exhaust port sizes and circumferential extents can be changed to repeatably and predictably change the working fluid mass flow rate of two or more ports (intake and/or exhaust) 444, 446, 452, 454 independent of the working fluid mass flow rates of the remaining ports 444, 446, 452, 454, and independent of the identical intake pressures, identical intake temperatures, identical exhaust pressures, identical exhaust temperatures, rotary component(s) rotation rate, and rotation direction R.

In the second case, there are two intake ports 444 and 446 with different intake temperatures and/or pressures, and with a combined working fluid mass flow rate not equivalent to that of a single intake port 302 without wedge 442, and these intake ports 444 and 446 may be further divided multiple times to further divide what was intake port 302. Unlike with the first case, the fluid in fluid volumes 426 with pressures and temperatures of previous intake port(s) 444, 446, and (not shown) will expand or contract to the pressure of the next intake port 444, 446, or (not shown) as it gains access to that intake port 444, 446, or (not shown). Therefore, the last intake port to have access to each fluid volume 426 will have complete control of the equivalent of the intake port pressure, and that the proportion of fluid remaining in the fluid volume 426 from each intake port 444, 446, and (not shown) is a function of each intake port's fluid composition, pressure, and temperature with relation to the rest, the order of port access, as well as the change in volume of the fluid volume 426 while it has access to each intake port 444, 446, and (not shown). As the fluids with different temperatures are mixed within and without the fluid volume 426, their temperatures may equalize to a new temperature based on their initial temperatures and thermal masses, and this equivalent intake port temperature will be a function of the temperatures and thermal masses of the fluids at all the intake ports as well as any chemical reactions. With this assumption, there is still a single equivalent intake port pressure and single equivalent intake port temperature which may still be repeatably and predictably changed independently of the exhaust pressure, exhaust temperature, overall working fluid mass flow rate, rotation direction R, and rotary component(s) rotation rate as described previously. In addition, the intake and exhaust port sizes and circumferential extents may be changed to repeatably and predictably change the working fluid mass flow rate of two or more ports (intake and/or exhaust) 444, 446, 452, 454, independent of the working fluid mass flow rate of the remaining ports 444, 446, 452, 454, and independent of the equivalent intake pressure, equivalent intake temperature, identical exhaust pressures, identical exhaust temperatures, rotation direction R, and rotary component(s) rotation rate. The ideal gas equation ($pV=nRT$), combined with different intake pressures and/or the mixing of multiple fluids with different initial temperatures and the ability to control the working fluid mass flow rate of each intake port 444, 446 may be used to repeatably and predictably control the equivalent intake temperature, and do so independent of the overall working fluid mass flow rate, individual exhaust working fluid mass flow rates, the equivalent intake pressure, identical exhaust pressures, identical exhaust temperatures, rotation direction R, and rotary component(s) rotation rates. In turn, this control allows us to change the intake and exhaust port sizes and circumferential extents so that the temperature of each intake port 444, 446 may repeatably and predictably change independent of the temperature of every other intake port 444, 446 and independent each intake port pressure, the identical exhaust pressures, the identical exhaust temperatures, each exhaust port working fluid mass flow rate, rotation direction R, and rotary component(s) rotation rate.

Figure 5:
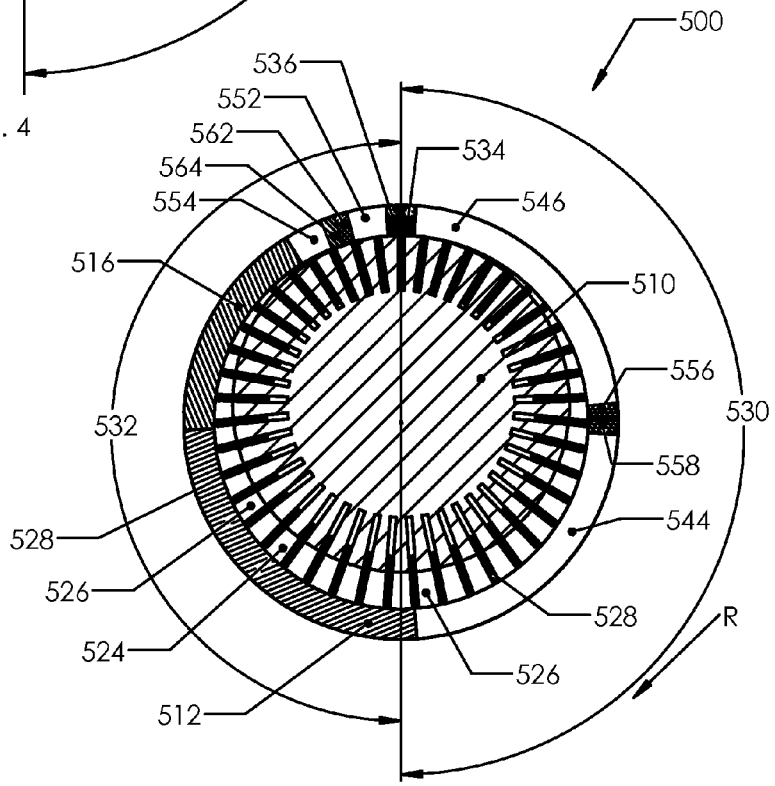
FIG. 5 is a transverse cross-sectional view of a vane-type REC device with eight slides.

However, allowing the compressible fluid at the various intake ports to equalize pressures as their volumes are connected is less energy efficient compared to using the device to equalize their pressures before they are connected. FIG. 5 shows an REC device 500 that is similar to REC 400 shown in FIG. 4. Indeed, the respective names and functions of features 510, 512, 516, 524, 526, 528, 530, 532, 534, 536, 544, 546, 552, 554, and R in FIG. 5 are identical to the corresponding features 410, 412, 416, 424, 426, 428, 430, 432, 434, 436, 444, 446, 452, 454, and R in FIG. 4 respectively, though their shapes and sizes may differ. As described previously, a single wedge 442, 448, or (not shown) may be replaced by splitting the wedge's slide helix (not labeled) into two slide helixes and two additional slides 556, 558, 562, 564 in place of two wedges, for example, wedges 442, 448 in REC device 400. With all the ports 544, 546, 552, 554, circumferentially constrained by slides 512, 516, 534, 536, 556, 558, 562, 564, the sizes and circumferential extents of all ports 544, 546, 552, 554, may all be changed independent of all others, their locations may be switched, and they may even be combined, thereby removing the assumption that there is no pressure change that is induced by REC device 500 between any of the ports 544, 546, 552, 554. As a result, the port sizes and circumferential extents may be changed so that the pressures and temperatures of the multiple exhaust ports may be repeatably, predictably, and independently made to be different, just as different pressures and temperatures of the multiple intake ports may be repeatably and predictably accommodated without the losses incurred as in REC device 400, and all independent of the working fluid mass flow rate of each port, rotation direction R, and rotary component(s) rotation rate.

Because Work is equal to the torque multiplied by the angular rotation: $dW=\tau*d\theta$; dividing both sides of the equation by time results in Power equal to the torque multiplied by rotation rate: $dW/dt$, $P=\tau*\omega$. From thermodynamics, $W=(p_2V_2-p_1V_1)/(1-n)$, and therefore $(p_2V_2-p_1V_1)/(1-n)*(d/dt)=P=\tau*\omega$.

The rate of change in volume of the fluid volumes per rotary component(s) rotation may be increased by changing only the working fluid mass flow rate for, making the Torque a function of the difference in pressure across the intake port(s) 202, 302, 444, 446, 544, and 546, for example, and exhaust port(s) 206, 306, 452, 454, 552, and 554, for example, and the working fluid mass flow rate. Because all port pressure(s) may be changed independently as described previously, a change to any one or more port pressure will result in a change to the pressure differential between the intake port(s) and exhaust port(s). Therefore, one or more port sizes and circumferential extents may be changed to repeatably and predictably change either the pressure differential, the working fluid mass flow rate, or both, to change the torque, independent of rotation direction R and the rotary component(s) rotation rate.

Power is a function of the difference in pressure across the intake port(s) 202, 302, 444, 446, 544, and 546, for example, and exhaust port(s) 206, 306, 452, 454, 552, and 554, for example, the working fluid mass flow rate, and the rotary component(s) rotation rate. Because of this, the port sizes and circumferential extents may be changed to repeatably and predictably change the pressure differential, the working fluid mass flow rate, rotary component(s) rotation rate, or any combination thereof, to change the power independent of rotation direction R.

Whereas a compressor or expander as described in the previous examples is understood to transfer torque and power from a rotating body to a compressible fluid, a motor as it is described in this document is understood to do the reverse: transfer torque and power from a compressible fluid to a rotating body. REC devices may be used as both a compressor/expander and a motor with a reversal of the flow and rotation direction. However, since the rotation direction may be made independent for REC devices, they may be used as a motor without the required reversal of direction.

Figure 6:
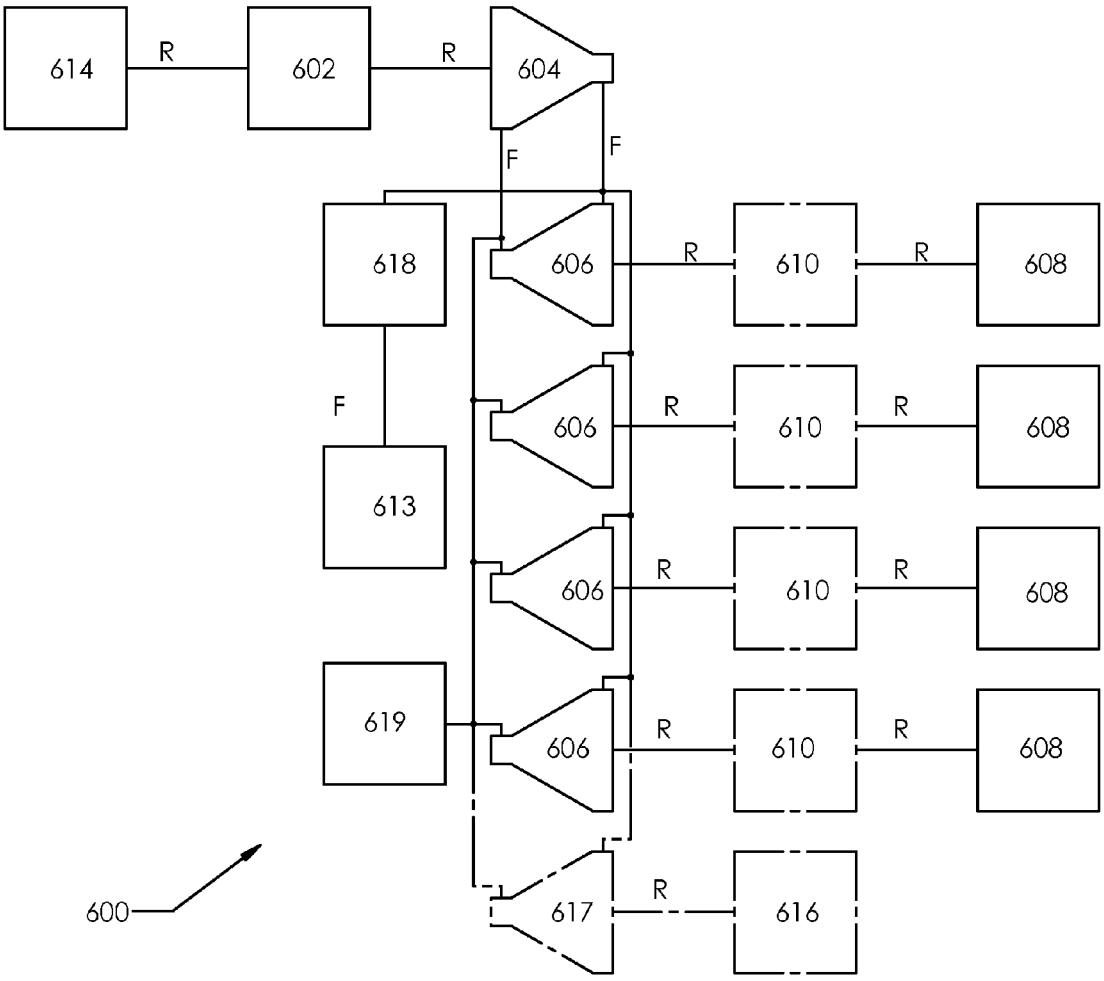
FIG. 6 is a schematic diagram of a system of REC devices and other components used to transmit power in an efficient manner.

Unlike with conventional pneumatic compressors and motors, REC devices need not be designed with a certain pressure, rotation rate R, rotary component(s) rotation direction, or working fluid mass flow rate to operate at high efficiency, and can change all four independently of each other as described previously. An efficient variable speed transmission may therefore be constructed with one or more REC devices. Take, as an example, a transmission 600 on an all-wheel drive car, schematically illustrated in FIG. 6. An engine 602 will typically perform at optimum efficiency for a certain power vs. rotation rate curve. An REC device acting as a compressor 604 is tied rotationally R to the output engine 602 and can compensate for the variable power and rotation rate to provide a working fluid F at a desired pressure to another REC acting as a motor 606 at each wheel 608 of the car. This pressurized working fluid F may come from a single common exhaust port (not labeled) as shown in FIG. 6 or may come from multiple exhaust ports, and the compressor exhaust port pressure(s) may vary over time, depending on the designer's desires. Each motor 606 then independently uses as much compressed working fluid F as required to provide as much power as is desired at each wheel 608. Each wheel 608 may be rotationally connected R to each motor directly or by fixed or variable transmission 610, which if it is variable, may be controlled separately for each wheel 608. Because the compressor 604 and motors 606 can effectively stop pumping without affecting the rotation rate of the engine, and can be independently controlled to match a different wheel transmission 610 rotation rate before it is engaged, a clutch system is not required.

As more power is required by a wheel 608, the wheel's motor 606 increases its working fluid mass flow rate. This may be fully or partially compensated by the compressor 604, placing increased power demands on the engine 602. If the working fluid mass flow through the compressor 604 does not match the combined fluid flow through all the motors 606, the compressed working fluid pressure will change, which both the compressor 604 and motors 606 can compensate for without a loss in efficiency. If a first one or more reservoirs 613 are also connected to the output(s) of the compressor 604, it will slow this change in pressure, effectively providing a battery or booster for when the engine 602 is unable to keep up with the power demands of the wheel motors 606.

If the motorist brakes, the REC devices acting as motors 606 may switch function to act as compressors, reversing the working fluid mass flow rate while maintaining their direction of rotation, thereby increasing the pressure and mass of fluid within the high pressure reservoir(s) 613 while reducing the velocity of the car, and thereby acting as a regenerative braking system and removing the need for a friction based braking system. Generally this would imply that the compressor 604 attached to the engine 602 would maintain the reservoir 613 at a pressure lower than its rated pressure so that the regenerating brakes could increase the fluid pressure in the reservoir 613 without exceeding its capability or requiring a pressure relief valve (not shown), though such a valve would be desirable for extreme circumstances. However, the reservoir pressure could be maintained by the compressor 604 per a formula based on the maximum pressure minus the pressure expected to be gained by bringing the vehicle to a stop, given the current vehicle speed and weight. Several additional variables could be added to this formula depending on desired efficiency, performance, the reservoir's capacity, hilliness, etc.

The alternator 614 might be rotationally connected directly to the engine 602, but any fans, air conditioning compressors, windshield wipers, and/or other powered devices 616 that previously used an electric motor could instead use an REC device configured as a motor 617, all driven off the same or a different compressor 604 and reservoir 613. Finally, if a valve 618 is used to retain pressure in the high pressure reservoir(s) 613, the engine's REC device 604 could instead be used as a motor 604 to start the engine 602, removing the need for a starter motor.

Using a closed fluid loop F system with a dry working fluid like dry Nitrogen and a low pressure working fluid reservoir 619 would increase efficiency, as would thermally insulating both the high and low pressure sides of said closed loop F.

A similar system could be used on a train, with quick connect hoses linking all the train cars and motors 606 on each pair of wheels or on each dolly on each car, and with multiple compressors 604 attached to multiple engines 602 on multiple engine cars. Because the cars would not be pushing or pulling each other, the train could be built lighter, and could turn through much tighter track bends because the cars wouldn't be pushed or pulled off the tracks.

A similar system could be used as a power distribution system, with the fluid connections connecting many REC devices acting as compressors and/or motors, with physical locations of said REC devices next to each other, or up to thousands of miles apart.

Figure 7:
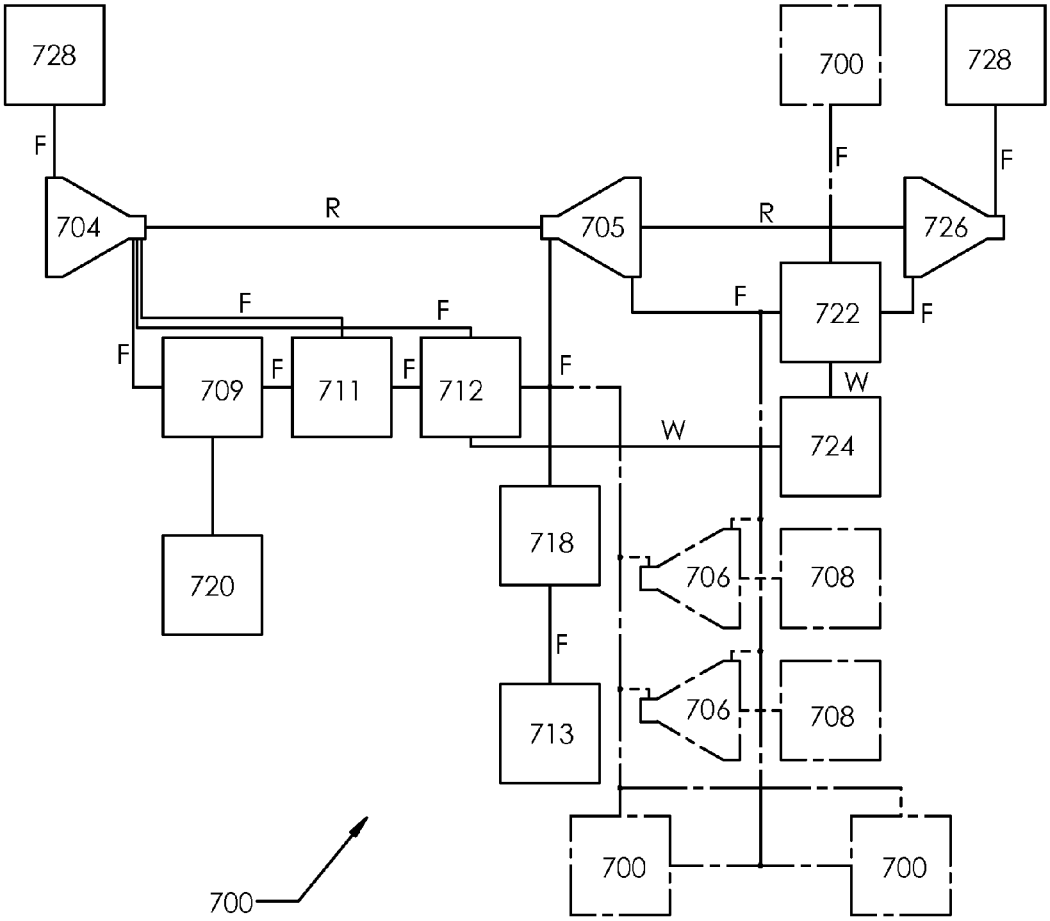
FIG. 7 is a schematic diagram of a system of REC devices and other components used to generate and transmit power in an efficient manner.

In its simplest description, a turbine engine is a compressor and a motor with a linked rotation rate and with a combustion chamber between the exhaust of the compressor and the intake of the motor. The compressor is driven rotationally by the motor, with the combustion chamber increasing the temperature of the working fluid from when it exits the compressor to when it enters the pneumatic motor, thereby providing a larger volume of working fluid at the same pressure for the motor than was provided by the compressor; and thereby providing more power generated by the motor than is required by the compressor. As shown in FIG. 7, the same model may be used to make an engine 700 using REC device(s) used as compressor(s) 704 and motor(s) 705, and the following modifications could produce associated benefits.

For example, because the fluid flow rate of both the compressor 704 and motor 705 can be controlled without the losses induced by the use of a flow restrictor or similar, the power provided by the engine can be controlled without a corresponding loss in efficiency.

Instead of having a separate transmission compressor attached to the engine 700, a separate exhaust port from the engine's compressor 704 could be used to supply pressurized working fluid to any motor(s) 706 for other powered devices 708 not necessarily rotating at the same rate as the engine 700 (like the wheels of the car as described previously). An even more efficient option might be to have these motor(s) 706 powered directly by the exhaust of the combustion chamber(s) 709, 711 and/or mixing chamber 712.

Air from a high pressure reservoir 713 controlled by a valve 718 could be fed directly to the motor 705 to start the engine 700, removing the need for an electrical starter motor and significantly reducing the maximum power draw on any electrical battery. Alternately, the combustion chamber(s) 709, 711 could be equipped with an igniter, so that the engine could be started directly by combustion from a dead stop and not require any initial rotation.

Because both the compressor 704 and motor 705 can be designed and used to be able to adjust to their own intake and exhaust pressures, there is no loss from over-pressurized fluid entering the combustion chamber(s) 709 and 711, nor a similar loss from over-pressurized fluid exiting the exhaust of the motor 705, which provides the ability to retain optimum efficiency while delivering a variable power output and removes the need for an exhaust sound muffler.

Because the pressure of the combustion chamber(s) 709 and 711 can be controlled by the engine, its temperature can also be controlled, allowing for diesel-engine-like combustion and removing the need for spark plugs, solenoids, and their associated controls.

As with a multi-cylinder engine, multiple compressors 704 and motors 705 could be attached to the same or multiple combustion chamber(s) 709 and 711. This would allow for efficiencies of quantity as well as scale, as well as allowing the same base REC device to be used in different quantities for different applications with different power requirements. This could also allow for the redundancy benefits of having multiple engines 700, rotationally connected and/or disconnected, and could allow for higher efficiencies over a broader power range by starting and stopping engines 700 as required.

Because the compressor 704 can have multiple exhaust ports (not labeled) with the same (or differing) pressures and individually controlled working fluid mass flow rates, one port could lead to a first combustion chamber 709 which could control how much fuel was burned from a fuel reservoir 720, and a second port to a second combustion chamber 711 could complete the combustion process and possibly control emissions instead of using a catalytic converter on the exhaust of the engine 700. By moving the entire combustion process to between the compressor 704 and the motor 705, the engine's efficiency would increase. Furthermore, because the working fluid mass flow rate into the first combustion chamber 709 is able to control how much fuel is combusted and moved to the second combustion chamber 711, the fuel would not need to be controlled by fuel introduction rate, and so large pieces of solid fuel could be used in place of liquid fuel, yet full control of the combustion rate could be maintained without requiring a less-efficient method of restricting its exposure to combustion.

A tertiary exhaust port (not labeled) from the compressor 704 could be connected to a mixing chamber 712 used to cool the fully combusted fluid to a temperature that the components of motor 705 could easily withstand, thereby retaining all the energy of combustion prior to the motor 705 and removing the need for a cooling system for the engine components. As another non-exclusive option, water W or some other liquid could be introduced into the mixing chamber 712. The water W could heat to a gas and provide the same cooling effect without requiring the compression of as much additional working fluid. If a cooling condenser 722 were employed just after the motor 705 to reclaim near boiling water from the working fluid, a water pump 724 could be used to reintroduce it into the mixing chamber so that little or no additional water W would need to be stored or added by the user and the water W introduced to the mixing chamber 712 would be preheated for an increase in efficiency.

In addition, one or both of the (first and second) combustion chamber(s) 709 and 711 may be replaced with one or more heat exchangers (not shown), which could enable further efficiency gains, such as by using the hot exhaust of an engine to provide the heat to power a secondary engine, or cooling the hot exhaust within a bounded volume and using its change in pressure to increase the power of the engine. Attaching a heat exchanger (not shown) to the exhaust of a combustion engine, and thereby combining it with the afore mentioned cooling condenser 722, would allow the use of the remaining heat in that exhaust to power a second engine 700, thereby increasing the efficiency of the two engines. If a second heat exchanger were combined with the cooling condenser 722 and used on the non-combustion engine to cool its exhaust so that it could be fed back into its compressor, that engine could use a closed working fluid loop, allowing more efficient working fluids to be used in its thermo-cycle. Multiple stages of these secondary engines (not shown) could be used in series to further increase the efficiency of the combined engines.

Further efficiency could be obtained in both the combustion and non-combustion engines by bounding the cooling fluid, and thus gaining power from its recompression. If the cooling condenser/heat exchanger 722 for the exhaust were its own (negative) pressure chamber, and if the working fluid mass flow rate in from the motor(s) were equal to the working fluid mass flow rate out by a REC acting as a (re)compressor 726, then said chamber 722 could be set to a negative pressure and power could be gained. This is because the working fluid volume flow rate out of said pressure chamber would be lower than the working fluid volume flow rate in, and thus it would take less energy to recompress the fluid to ambient pressure 728 than the energy gained by the motor 705 exhausting to a pressure that is less than ambient 728. If, instead, the heat exchanger were incorporated into a compressor (not shown), then the pressure of the fluid could be reduced within the compressor, which would induce the compressor to turn as the product of the pressure and volume of the fluid shrank.

Current methods of efficient refrigeration use a compressor to compress a compressible fluid and then allow the fluid to cool in a heat exchanger to the extent that the fluid precipitates to an incompressible liquid state before being expelled through a valve into another heat exchanger where the fluid is allowed to evaporate and warm. While this has many advantages over older technologies, it relies on the availability of a stable, noncorrosive, nontoxic, fluid with a liquid to gas vs. pressure/temperature transition curve which fits within the operating pressure capabilities and temperatures of the desired environments. It can be inferred that, where such a fluid is not yet available or is not cost effective, having a system that does not rely on the precipitation of the fluid would be beneficial and efficient if the energy released by the reduction in pressure of the compressed fluid were recoverable. Other specific applications might also benefit from such a setup, such as a refrigeration cycle with widely varying input and/or output targets for which a single precipitation curve would not be ideal in most cases, or such as an application where any of the temperature and/or heat transfer rate and or power consumption variables must be held tightly.

Figure 8:
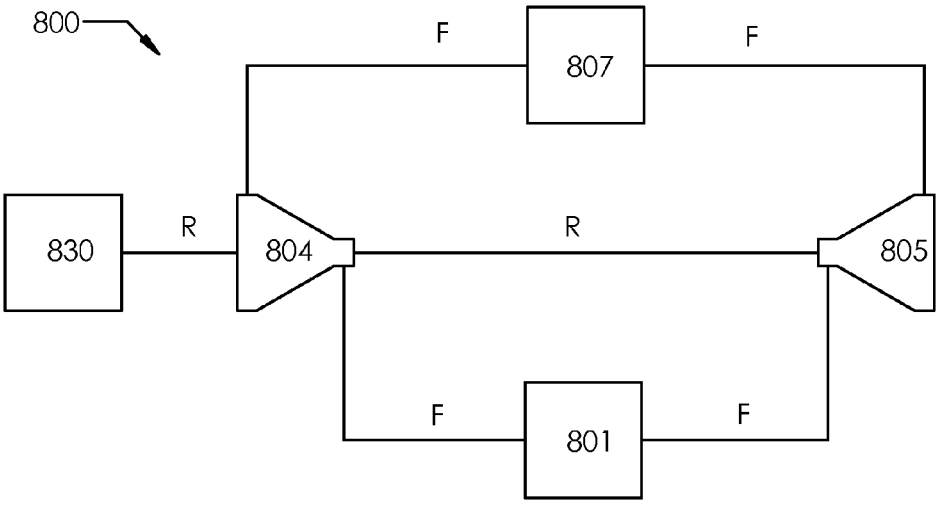
FIG. 8 is a schematic diagram of a system of REC devices and other components used to transmit heat in an efficient manner.

Such a refrigeration system 800 can be accomplished as shown in FIG. 8. In this case, a first heat exchanger 801 connects the exhaust of an REC device used as a compressor 804 and the intake of another REC device used as a motor 805 on the high pressure hot working fluid side, and second heat exchanger connects the exhaust of the motor 805 and the intake of the compressor 804 on the low pressure cold working fluid side. The rotary component(s) of the compressor and the motor are rotationally linked R and further driven by an external power source 830. In the steady state, the compressor 804 takes in a larger volume of working fluid than the motor 805 exhausts. As discussed previously, the compressor 804 can adjust to the working fluid mass flow rate and pressure differential (and thus temperature differential) requirements of both the system and the operator to satisfy any power and thermal requirements. The motor 805 can then adjust to the shared input and output pressures of the system to ensure that the differential temperature is maintained while regaining the power from the expansion of the working fluid due to said pressure differential.

A heat pump as is used in heating, ventilation, air-conditioning (HVAC) systems uses a refrigeration cycle to transfer heat from one fluid to another through the use of one or more pumps driven by an auxiliary power source and the compression and expansion of a fluid. In some applications of heat pumps, a furnace burns fuel(s) to obtain heat, and then transfers some of that heat to another fluid, while expelling the rest to the atmosphere with its exhaust. The colder the ambient temperature with relation to the temperature of the controlled environment, the less heat efficient the process.

Figure 9:
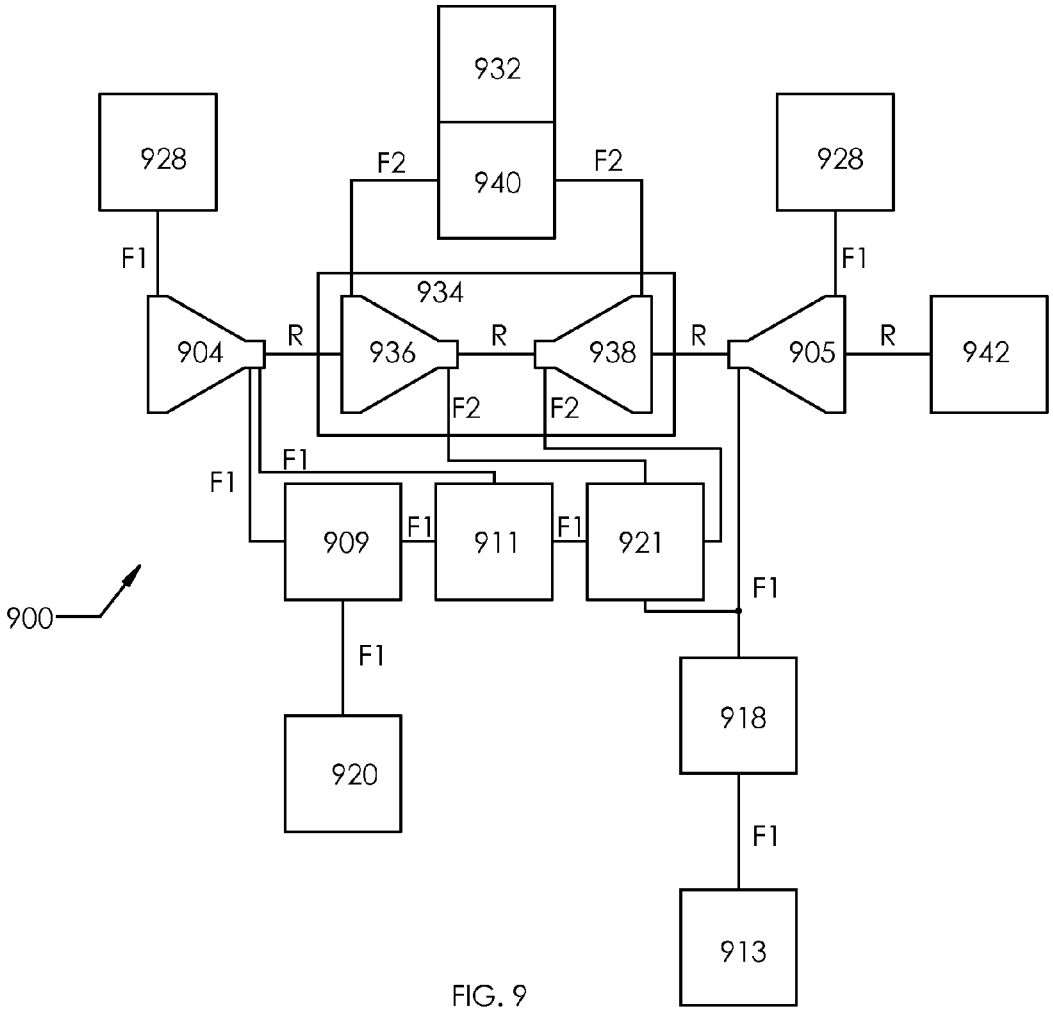
FIG. 9 is a schematic diagram of an open loop system of REC devices coupled to a closed loop system of REC devices, and other components, used to generate and transmit heat in an efficient manner.

As shown in FIG. 9, a heat engine 900 may be made from an REC device used as a compressor 704 and motor 705 used as an engine as in FIG. 7, with one or more combustion chambers 909 and 911, working fluid reservoir(s) 913 and associated control valve 918, and fuel reservoir(s) 920 but with the addition of a heat exchanger 921 between the combustion chamber(s) and the motor 905. In this case, the objective is to take in air F1 from the ambient, increase its temperature beyond that which is desired in the controlled environment 932 solely by compressing it, then add energy in the form of heat by use of the combustion chamber(s) 909 and 911 as in engine 700, then transfer the heat gained from said combustion to another working fluid F2, before then regaining the energy lost from compressing the ambient air F1 by expanding it in a motor 905 and releasing it back to ambient 928. Losses would occur in the compressor 904 and motor 905, which might necessitate that the air returned to the ambient 928 atmosphere be at a higher temperature than it was when it started the process. This might be overcome, and the expelled air F1 might even be returned at a lower temperature, if the system is driven by an additional method. One such method might involve supplementing the system with an electric motor (not shown). While this electric motor might be driven by an external power source, the transfer of the heat from the compressed and combusted air F1 to the controlled environment may also be used to supplement the heating engine.

One option might be to deliver the heat from the heat exchanger 921 to the compressed working fluid of a second engine 934, made up of third and fourth REC devices, one of which is used as a compressor 936 which draws its working fluid from the controlled environment and the other of which is used as a motor 938 which returns its working fluid to the controlled environment. Rotationally linking the rotary component(s) of the first and second engines would complete the power transfer, and the second engine 934 would add power to the system if the temperature of the compressed controlled environment working fluid F2 were low enough and could be increased enough from the heat exchanger so that it not only overcame the additional losses from the second engine 934 but was able to contribute rotational energy to the first (not labeled). This second engine 934 could also have a closed fluid loop with another heat exchanger 940, and might even provide enough additional power to drive a blower fan or other equipment 942 to push air from the controlled environment 932 across its heat exchanger 934.

Another option would be to incorporate a thermocouple array (not shown) into the heat exchanger 921 through which any heat must travel to get from one fluid to the other, thereby gaining electric potential and current while reducing the weight efficiency of the heat exchanger. This electric potential and current could then be used for any purpose, another of which could be driving the controls of the engines of the system. These two options could also be combined.

The above options would function as a heating system with an energy efficiency of >100% of the potential energy of the fuel used to power the system, and which may function well for a wide range of both ambient and controlled temperatures.

It has previously been assumed that the pressure of the exhaust of all exhaust ports are made to be equal to the ambient pressure at those ports. This eliminates energy losses due to the sudden and unharnessed expansion at an exhaust port if two compressible fluids with different pressures are allowed to mix. The benefits of energy efficiency may be outweighed by the benefits of volume and/or weight efficiency in different applications, and these benefits may vary from application to application, as well as over time within the same application.

Systems such as those described previously may be configured so that, within a certain power range, the pressure of the exhaust and the ambient pressure at the exhaust port are the same, and at a power level greater than that range, these pressures are different. Thus, the system would be very energy efficient at a lower power range, but would exchange some of its energy efficiency for volume and/or weight efficiency at higher power ranges. Instead, the system might not have a high energy efficiency range at all, and always sacrifice its energy efficiency for volume and/or weight efficiency.

For those cases where it is desirable to the user for the system to remain at or above a certain energy efficiency range, a first option might be for a power limit on the system may be set by the user which may be turned on or off, and/or changed by the user, and which may or may not be the same as the power level at the high end of the most energy efficient power range. In this way, a system may be, voluntarily or otherwise, limited to its most or more energy efficient power range.

As an alternative second option, the limit may be set, with a switch or other method of releasing the system from this limit in case of an emergency or other event, defined by either the user or some other system. In this way, a system may be, voluntarily or otherwise, allowed to exceed its normally highly energy efficient power range at the cost of its energy efficiency.

Both the previous options may be used in the same system for different ranges of power and energy efficiency. If, for example, the system will be progressively damaged above a certain power rating, the first option might be used for a lower energy efficiency power range below where the system would be damaged, and the second option might be used for a power range above.

In all three cases above, it may be found that a switch is not desirable to turn on or off the limit. User feedback, such as a noticeable increase in resistance to the user's pressure on a throttle as each range limit is crossed, may be used instead of a switch, allowing for a more intuitive and less restricting interface.

Though the examples described in the previous text and figures focus on helical slides with a potential multitude of slides, wedges, and adjustable ports, the following focuses on obtaining the highest efficiency in a manufacturable design which includes only 2 equivalent adjustable ports and could function as a combination of components 704, 705, and 726 in FIG. 7.

In obtaining the highest energy efficiency, it is desirable to reduce or eliminate any and all reciprocating motion in the device. Along the same lines of thought, it is also desirable for all rotating bodies to be balanced so that the axis of rotation of each body also passes through its center of mass. The gerotor eliminates all such reciprocating motions and, so long as both the internal and external gears are in rotation while their centers of rotation are held fixed, their axes of rotation also inherently pass through their center of mass. Furthermore, it is possible to create gear sets so that if one of the gears is rotating at a constant rate of rotation, the other is also rotating at a constant rate of rotation, which also eliminates losses in efficiency due to forced changes in angular velocity in the steady state.

In obtaining the highest energy efficiency, it is desirable to completely expel all the compressible fluid before again taking in more fluid. This means that, in the course of rotation, all fluid volumes must begin and end with zero volume. Because it is undesirable for the slides to move with or in response to the efficient rotation of the device in order to maintain correct access between the port and its associated volumes in the steady state, it is desirable to fix this zero volume location with relation to the fixed coordinate reference. In examining the typical N:N+1 gear set, it is seen that the geometry which has been found to be efficient in transferring torque from the one gear to the other is not at all energy efficient in this described manner. It does, however, suggest that the best place to fix this zero volume location is where the gear teeth are most fully enmeshed. On further examination of said N:N+1 gear set, it is seen that the primary reason that the fluid volumes between the teeth of the gears do not approach zero is because the tips of the teeth (of either gear) are never instantaneously stationary with respect to its mate at this fully enmeshed location, but instead are allowed to swing through an open space left for it so that the gears do not bind. To remove this open space and thus move to a zero volume at this location, the swing must be removed. Thus, we start with the tip of the teeth of either the rotor or the stator (or both) being instantaneously stationary with respect to its mating pocket at its fully enmeshed location.

Mathematically, this means that the vector of travel of the tip of a tooth in the fully enmeshed location as described above must instantaneously match its mating part in its mating gear at the location of zero volume. Further, if a rotating coordinate reference is established with its location at the center of rotation of the tooth's mating gear and which rotates at the same rate as that mating gear, then because the tooth is not allowed to swing through this fully enmeshed condition, it must approach and leave this location instantaneously before and after the location of zero volume along vectors parallel to the line drawn between the rotational axes of the gears when plotted on the rotational coordinate system. This line is also parallel to a line drawn between the said tip of the tooth and the rotational axis of either gear on the rotational coordinate system. In this way, the tip of each tooth instantaneously appears to reciprocate as a piston when viewed from the rotational coordinate reference, even though there is no reciprocating motion when viewed from the fixed coordinate reference.

In examining the typical N:N+1 gear set, it is seen that, from time to time, discrete volumes merge and separate from each other due to the way the gear teeth fail to maintain contact at all times with their mating gear. This is not desirable because volumes which have different pressures may merge and equalize their pressure, thereby reducing efficiency as discussed previously. Because the tips of the teeth of one or both gears will be defining the extents of the mating gear, it is desirable for each tooth that defines the boundary between one volume and the next to maintain contact with its mating gear at all times so that the two volumes bounded by that tooth do not merge.

Based on the above, it has been determined that either the internal or the external gear teeth may be made to satisfy all the conditions of a highly efficient device, but not both. Two generic solutions have been found to express the form that the teeth would take, one with the internal gear tooth tips acting to define the external gear as described above, and one with the external gear tooth tips acting to define the internal gear as described above. The first solution, represented by equations Equation 1-7, below, is described in the most detail because it is the more robust and volume efficient option.

$$\text{NoET}=\text{NoIT}+1 \qquad \text{Eq. (1)}$$

with:

NoET is defined as the number of teeth on the external gear; and

NoIT is defined as the number of teeth on the internal gear. Equation 1 mathematically expresses the N:N+1 condition stated above. Thus, for every rotation of the external gear, the internal gear will rotate (n+1)/n times. Stated another way, every time the internal gear makes a complete rotation, it will advance its position with relation to the external gear by one tooth, and this advance will be $1/(n+1)^{th}$ of a full rotation of the external gear and $(1/n)^{th}$ of a full rotation of the internal gear.

Referring to FIGS. 10-13 for geometric reference, for the case where the internal gear tooth tips are used to describe the external gear, the following Equations 2-4 are useful:

$$\theta = \Delta - \arctan\left(\frac{TH \cdot \sin(-\delta + \Delta)}{E + TH \cdot \cos(-\delta + \Delta)}\right) \qquad \text{Eq. (2)}$$

$$r = \sqrt{(E + TH \cdot \cos(-\delta + \Delta))^2 + TH^2 \cdot \sin(-\delta + \Delta)^2} \qquad \text{Eq. (3)}$$

$$\Delta = NoIT \cdot \delta \qquad \text{Eq. (4)}$$

wherein:

TH (1002 and 1202) is defined as the tooth height, which is the distance between the gear's axis of rotation and the tip of the tooth 1003 and 1203;

E (1004 and 1204) is defined as Eccentricity, which is the distance between the internal gear's axis of rotation 1005 and 1205 and the external gear's axis of rotation 1006 and 1206;

Δ (1007 and 1207) is defined as the angle the external gear has rotated;

r (1008 and 1208) is defined as the distance from the center of the external gear to the tip of one of the internal gear's teeth, thus defining the internal wall of the external gear;

δ (1010 and 1210) is defined as the angle that the internal gear has rotated with relation to the external gear; and θ (1012 and 1212) is defined as the angle of 'r' from with relation to the external gear.

Figure 10:
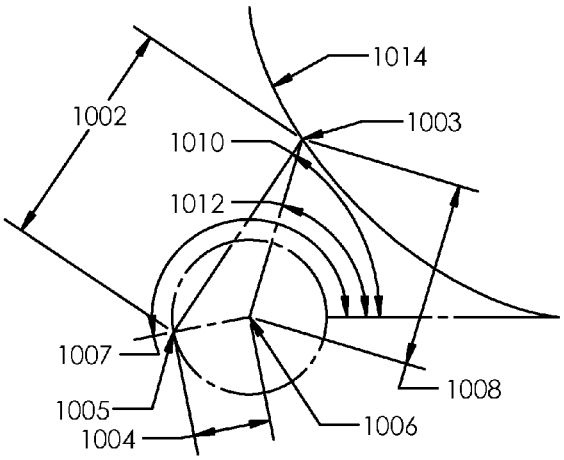
FIG. 10 is a diagram describing part of the geometry of a gear which may be used as part of a rotary component in a REC device.

Through experimentation, it has been found that when $$TH=E\cdot \text{NoIT} \quad \text{Eq. (5)}$$

is enforced, the piston motion as described above is obtained. Substituting Equations 4 and 5 into Equations 2 and 3 yields $$\theta = -NoIT\cdot\delta + \arctan\left(\frac{NoIT\cdot\sin(\delta + NoIT\cdot\delta)}{1 + NoIT\cdot\cos(\delta + NoIT\cdot\delta)}\right) \quad \text{Eq. (6)}$$

and $$r = E\cdot\sqrt{(1 + NoIT\cdot\cos(\delta + NoIT*\delta))^2 + (NoIT\cdot\sin(\delta + NoIT\cdot\delta))^2} \quad \text{Eq. (7)}$$

and FIG. 10 shows the resulting single trough arc 1014 for a NoIT of four. Because E 1004 and 1204 and NoIT are both constant values of the gear shape, only δ 1010 and 1210 remains as a variable on the right side of either equation, allowing the parametric plot of each equation for each combination of E 1004 and 1204 and NoIT. (As is understood by a person having ordinary skill in the art, when solving for θ, π must be cumulatively added to the result of the arctan expression whenever it crosses a discontinuity or an incorrect and disjointed plot will result.) Alternatively, δ 1010 and 1210 may be solved in terms of θ 1012 and 1212, and then plugged into Equation 3 or 7 to obtain a correct plot. Both equation sets may also be converted into the Cartesian Coordinate System if desired.

As stated above, it is desirable that all volumes bounded by the gear teeth begin and end with zero volume. Thus, the teeth of the external gear are used to define the teeth of the internal gear. However, because the teeth of the external gear will be sweeping through the trough between the teeth of the internal gears, the entire geometry of the external gear is relevant. Because the external tooth is sweeping through the trough and because it is desirable to maintain contact between the trough and the tooth for the entire sweep, the contact point between the tooth and trough is at the point on the tooth where the direction of sweep is tangent to the surface of the tooth. However, solving for this yields the same shape as solving Equations 6 and 7 with the same but for one less internal tooth. Solving for an E 1004 and 1204 of one and an NoIT of three and two yields an external and internal gear set.

Figure 11:
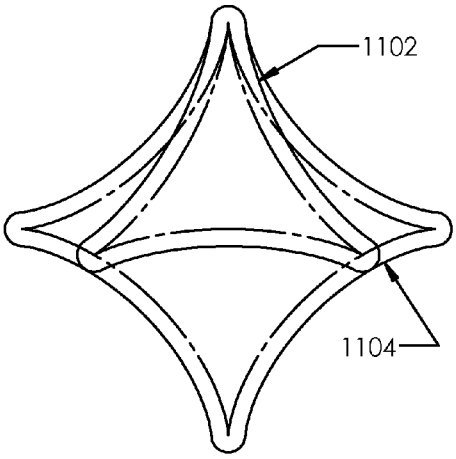
FIG. 11 is a view of two gear profiles that may be used as rotary components in a REC device.

While desirable from an efficiency standpoint based on the above, the points at the tips of the teeth of the gears are mechanically weak, will wear easily, are difficult to manufacture, and will not generate as tight a seal as may be desirable. However, the gears may be modified by offsetting the face of each gear by a fixed amount. Because the tip of each tooth is a point, a constant offset at the tip becomes a semicircle, yielding and internal gear with three teeth 1102 and an external gear with four teeth 1104 as shown in FIG. 11. However, the curvature in the faces of the gears limits the amount of offset that may be applied without having the new theoretical face self intersect and fail. This curvature is tightest at the tips of the teeth, which is where the seal between the teeth is made at the zero or near zero volume condition, and thus where the pressure differential will be greatest, so it is undesirable to 'cheat' and push the offset too far into what will theoretically self intersect. However, not only do the teeth become mechanically stronger as the offset increases, but the volume efficiency of the gear set increases marginally at the same time. Because of this and other constraints, it is desirable to have the largest offset possible. Also, as the number of teeth per gear increases, the faces of the teeth must curve further, thereby decreasing the amount of offset before the theoretical faces self intersect. Eccentricity has no effect on volume efficiency, but as the number of teeth per gear increases, the volume efficiency decreases. Thus, it is desirable based on both the mechanical strength of the gears and from a volume efficiency standpoint that the NoIT be as low as possible.

At certain points in the gears' rotation, a tooth will reach a condition with its mating tooth where their tips are touching, and therefore in which their contact does not apply a rotational vector of force against each other, and just to either side of this condition, the rotational vector of force that may be applied is 1/∞ in one direction of rotation, and zero in the other. If there are an even number of teeth on the internal gear, then the tooth on the opposite side of the internal gear will be at the bottom of its mating trough, and thus be in contact with two teeth and able to apply a rotational vector of force in either direction. Any teeth that are not in one of the two conditions above will have only a single point of contact with its mating tooth/trough, and thus can apply a vector of force in one direction of rotation or the other, but not both. Thus, if there are only two teeth on the internal gear in this case, there would arise a condition in which one tooth had just passed the condition where it could apply a force in both rotational directions, and thus could only apply a force in one rotational direction, and in which the other tooth could apply only 1/∞ or effectively no force in the other. Thus, any force opposing the rotation of the internal gear would overcome the effectively zero force and cause the system to bind unless some outside mechanism were used to keep the internal and external gears aligned as they turned. Having 3 or more teeth on the internal gear in this case eliminates this issue.

For the case where the external gear tooth tips are used to describe the internal gear, the following Equations 8-10 may be generated:

$$\theta = \delta - \arctan\left(\frac{E\cdot\sin(-\delta + \Delta)}{TH + E\cdot\cos(-\delta + \Delta)}\right) \quad \text{Eq. (8)}$$

$$r = \sqrt{(TH + E\cdot\cos(-\delta + \Delta))^2 + E^2\cdot\sin(-\delta + \Delta)^2} \quad \text{Eq. (9)}$$

and $$\Delta = (NoIT + 1)\cdot\delta \quad \text{Eq. (10)}$$

Figure 12:
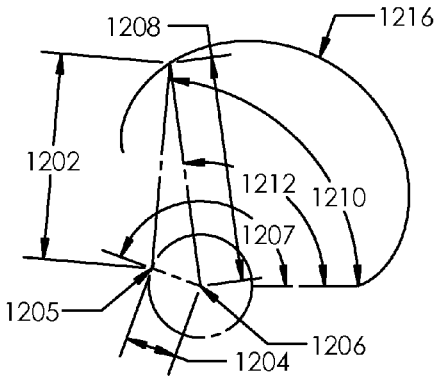
FIG. 12 is a diagram describing part of the geometry of a gear which may be used as part of a rotary component in a REC device.

Through experimentation, it has been found that when $$TH=E\cdot(\text{NoIT}+1) \quad \text{Eq. (11)}$$

is enforced, the piston motion as described above is obtained. Substituting Equations 10 and 11 into Equations 8 and 9 yields $$\theta = \delta + \arctan\left(\frac{\sin(NoIT\cdot\delta)}{1 + NoIT + \cos(NoIT\cdot\delta)}\right) \quad \text{Eq. (12)}$$

and $$r = E\cdot\sqrt{(1 + NoIT\cdot\cos(NoIT*\delta))^2 + \sin(\delta + NoIT\cdot\delta)^2} \quad \text{Eq. (13)}$$

and FIG. 12 shows the resulting single tooth arc 1216 for an NoIT of three. As before, because E 1004 and 1204 and NoIT are both constant values of the gear shape, only δ 1010 and 1210 remains as a variable on the right side of either equation, allowing the parametric plot of each equation for each combination of E 1004 and 1204 and NoIT. As before, δ 1010 and 1210 may be solved in terms of θ 1012 and 1212, and then plugged into Equation 9 or 13 to obtain a correct plot. As before, both equation sets may also be converted into the Cartesian Coordinate System if desired.

Figure 13:
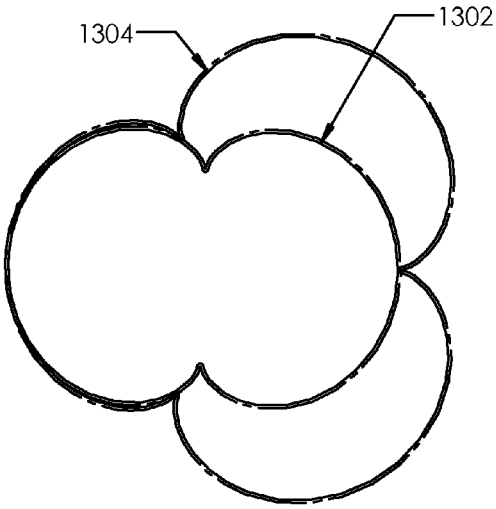
FIG. 13 illustrates two gear profiles that may be used as rotary components in a REC device.

Thus, solving Equations 12 and 13 for an E 1004 and 1204 of one and an NoIT of three and two yields an external and internal gear set, and offsetting the faces results in an internal gear with two teeth 1302 and an external gear with three teeth 1304 as shown in FIG. 13. Note that, since the outer gear is making contact at its tips, it is the one that needs three or more teeth, allowing the inner gear to have only two. Unlike with the previous 3:4 gear set above with fluid volumes which may always be accessed on the external gear at the bottom of each trough between the external gear's teeth, the 2:3 gear set and all sets made with its equations do not have the same constant access at the bottom of each trough between the internal gear's teeth.

Figure 14A:
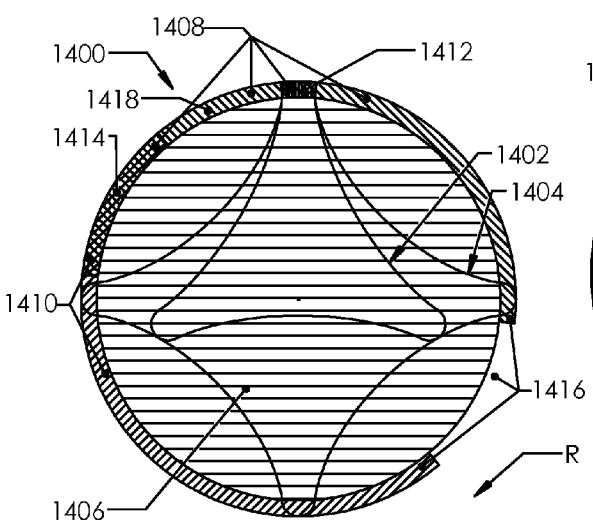
FIG. 14A is a cross sectional view of a REC device having slides and endplates.
Figure 14B:
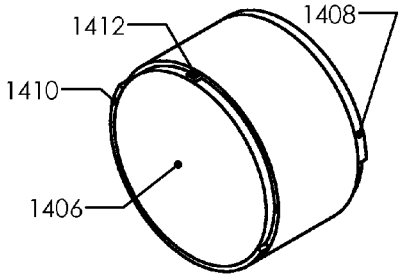
FIG. 14B is an isometric view of the REC device of FIG. 14A.

FIG. 14B is an isometric view of FIG. 14A. FIG. 14A-14B shows REC device 1400 which includes the 4:3 gear set of FIG. 11, where gear 1402 is functionally identical to 1102 and 1404 is functionally identical to 1104 with its extents not shown, and both are understood to have their centers of rotation fixed by mechanisms not shown, though they may rotate freely, gear 1402 within gear 1404. These two gears 1402 and 1404 are understood to extend to the same depth into the page and are parallel in that direction, and their end faces are understood to be coincident. Further, a region which is homogeneously hatched is understood to represent a cap zone 1406 flush to the ends of both gears which bounds the fluid volumes between the teeth of the gears 1402 and 1404, leaving only the bottom tips of the troughs of the outer gear 1404 unbounded. It is understood that at one end of this assembly 1400, there is a first slide zone 1408 which flush with that end of both gears which also bounds the fluid volumes at that end and over its circumferential extents but allows access to said fluid volumes outside its circumferential extents at that end (this access designated as access 1), which is also flush with cap zone 1406, and which has a fixed circumferential size but which extents may be moved freely around the circumference of cap zone 1406. It is understood that at the other end of this assembly 1400, there is a second slide zone 1410 which is flush with that end of both gears which also bounds the fluid volumes at that end and over its circumferential extents but allows access to said fluid volumes outside its circumferential extents at that end, which is also flush with cap zone 1406, and which has a fixed circumferential size but which extents may be moved freely around the circumference of cap zone 1406 except that its extents may not overlap a wedge zone 1412. It is understood that there is a wedge zone 1412 which is flush with and bounds the fluid volumes on the same end as slide zone 1410, which is flush with cap zone 1406, which has circumferential extents and a size fixed relative to the rotational axes of the two gears so that it overlaps all of but no more than the trough of the external gear when that trough is filled by one of the tips leaving a zero or substantially zero fluid volume. It is understood that, at the end of the gears shared by slide zone 1410 and wedge zone 1412, there will be at least one and as many as two circumferential extents of access to the fluid volumes, designated access 2 and access 3 (not labeled). It is further understood that, when viewed from one or the other end of the gears as shown in FIG. 14A, access 1 will overlap either or both access 2 and access 3.

REC device 1400 may function as REC device 200 as described below. When slide zone 1408 fully overlaps wedge zone 1412, there will be no access to the fluid volumes over the circumferential extents of wedge zone 1412, which zone functions as wedge 220 of REC device 200 of FIGS. 2A-2C. When slide zone 1408 and slide zone 1410 partially or fully overlap, the circumferential extents of this overlap act as a denied access zone 1414 to the fluid zones which is controlled by the circumferential extents of slide zones 1408 and 1410 in a manner similar to slides 212 and 216 of REC device 200 of FIGS. 2A-2C. Where no two of zones 1408, 1410, and 1412 overlap, access is made to the fluid volumes in a manner similar to ports 202 and 206. Assuming the rotary component(s) rotation direction R, intake port 1416 in FIG. 14A would act in a similar manner as intake port 202 of REC device 200, and exhaust port 1418 would act in a similar manner as exhaust port 206 of REC 200. In this way, an REC device may be constructed that eliminates all reciprocating motion of its rotary component(s). In addition, if additional wedge zones of similar circumferential extents to wedge zone 1412 but with the ability to be move circumferentially so long as they do not overlap any other zone at that end of the gears are added to access 2 and/or access 3, they may act as wedges 442 and 448 of FIG. 4.

Because the slides 1408 and 1410 and wedge 1412 are placed on the ends of the gears 1402 and 1404, two sets of rotary components may be rotationally tied to the other and placed end to end so that they may share a slide and may share a wedge, possibly reducing the number of parts required. If these two or more sets of rotary components were angularly offset to each other so that they shared the same axes but their fluid volumes gained and lost access to the shared port(s) at different times, it would have a similar 'smoothing' effect as increasing the NoIT, in that the working fluid mass flow rate would be more continuous and constant through smaller ports, but without the corresponding loss in volume efficiency of increasing the NoIT past three.

Figure 15A:
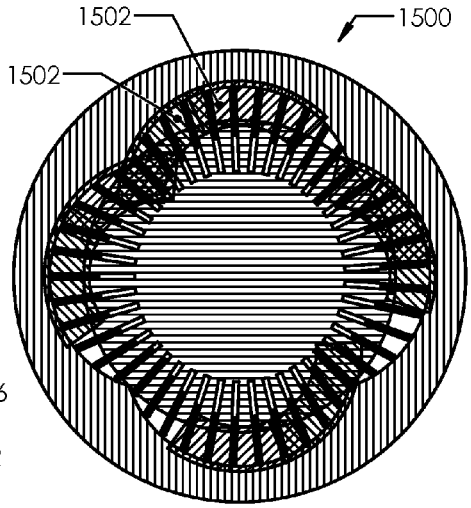
FIG. 15A is a cross sectional view of a vane-type REC device with a plurality of expanding arcs and a plurality of shrinking arcs.
Figure 15B:
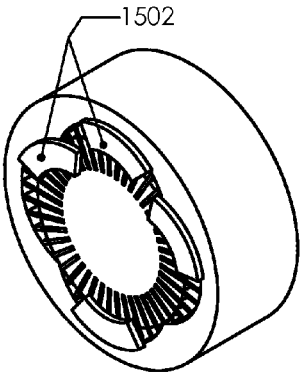
FIG. 15B is an isometric view of the REC device of FIG. 15A.

FIG. 15B is an isometric view of FIG. 15A. Because REC devices similar to REC 200 may be configured with multiple expanding arcs and multiple shrinking arcs as shown in FIG. 15A-15B, a single REC device may act as multiple of compressors and/or motors. REC device 1500 shows an example similar to REC 200 but which has the functionality of four of REC device 200 using slide zones 1502 (only some of which are labeled) on both ends of the rotary component(s).

Figure 16A:
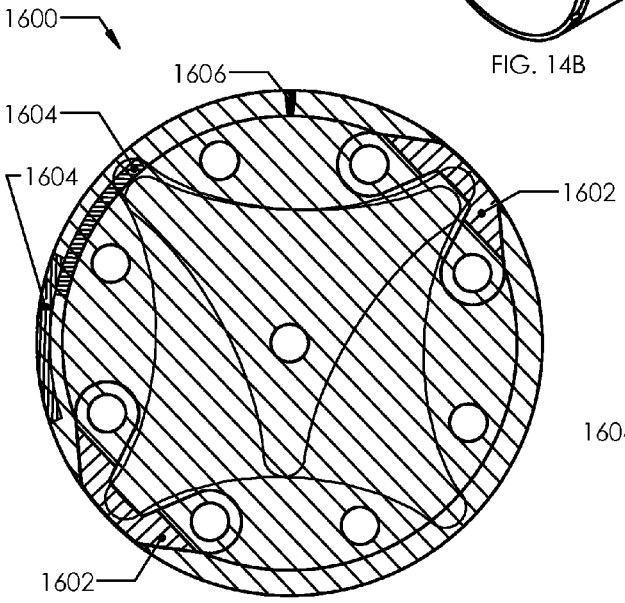
FIG. 16A is a cross sectional view of a REC device having valves coupled to a fluid zone.
Figure 16B:
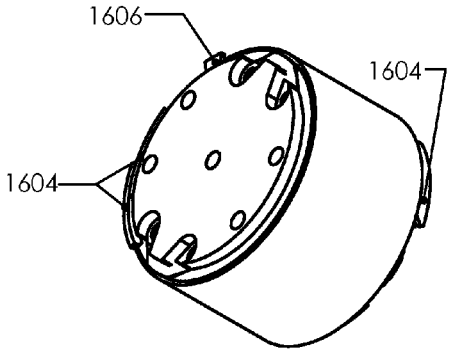
FIG. 16B is an isometric view of the REC device of FIG. 16A.

FIG. 16B is an isometric view of FIG. 16A. Because REC devices similar to REC device 1400 may be configured with valves or other methods of controlling the access of ports to their fluid volumes for only some of the gear troughs and with other methods to continuously block access to some other of the gear troughs as shown in FIGS. 16A-16B, and because the methods of controlling access may in turn be controlled by methods similar to the slides described previously, as shown in FIG. 16A-16B, a single REC device similar to REC device 1400 may act as multiple of compressors and/or motors. REC device 1600 uses two valves 1602 over two gear troughs on one end to allow or deny access to those gear troughs, and does the same on the other end with the remaining two gear troughs (not shown). This embodiment uses normally open valves 1602 with two slides zones 1604 and one wedge zone 1606 to control those valves 1602 on each end to provide the capabilities of two of REC devices 200, though normally closed valves and/or more sets of slide and wedge zones and/or further differentiation on how the slides interact with the valves and/or a gear set with a larger NoIT could all be used to further increase the capability of REC device 1600.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A refrigeration system, comprising:

a first rotary expansible chamber device having a first input port, a first output port, and a first port-adjustment mechanism designed and configured to controllably adjust a size or location, or both, of at least one of said first input port and said first output port;

a second rotary expansible chamber device having a second input port and a second output port, and a second port-adjustment mechanism designed and configured to controllably adjust at least one of said second input port and said second output port, said first rotary expansible chamber device mechanically coupled to said second rotary expansible chamber device; and first and second heat exchangers, said first heat exchanger fluidly coupled to said first output port and said second input port and said second heat exchanger fluidly coupled to said second output port and said first input port;

wherein said system is configured to operate as a closed-loop refrigeration cycle with a compressible working fluid, wherein both of said first and second rotary expansible chamber devices have a group of operating parameters consisting of (1) a mass flow rate of the working fluid (2) a temperature differential across said first or second rotary expansible chamber device caused by a change in volume of said working fluid in said first or second rotary expansible chamber device, and (3) a rotation rate of said first or second rotary expansible chamber device, wherein both of said first and second rotary expansible chamber devices are designed and configured to control all of the parameters in said group of operating parameters independently of all other parameters in said group by adjusting said first and second port-adjustment mechanisms.

2. A method of controlling a rotary expansible chamber (REC) device having at least one arc of inaccessibility and having a group of operating parameters consisting of (1) either a working fluid temperature differential or pressure differential across the REC device caused by a change in volume of the working fluid in the REC device, (2) a rotation rate of the REC device, and (3) a mass fluid flow rate through the REC device, the method comprising:

selecting an operating point for each of the operating parameters;

adjusting at least one of a location or an extent of the at least one arc of inaccessibility to control each of the operating parameters to be substantially equal to its corresponding operating point independently of controlling all of the other operating parameters in the group of operating parameters.

3. A method according to claim 2, wherein the REC device includes at least one of (1) a plurality of input ports or (2) a plurality of output ports, the method further comprising:

adjusting at least one of a location or an extent of the at least one arc of inaccessibility to control a mass fluid flow rate through each of the plurality of input and/or output ports independently of controlling a mass fluid flow rate through all of the other ones of the plurality of input and/or output ports.

* * * * *